US010324410B2

(12) United States Patent
Mochizuki et al.

(10) Patent No.: US 10,324,410 B2
(45) Date of Patent: Jun. 18, 2019

(54) IMAGE FORMING APPARATUS

(71) Applicant: KYOCERA Document Solutions Inc., Osaka (JP)

(72) Inventors: Masayuki Mochizuki, Osaka (JP); Mariko Kosaka, Osaka (JP); Yuya Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 114 days.

(21) Appl. No.: 15/497,996

(22) Filed: Apr. 26, 2017

(65) Prior Publication Data

US 2017/0315494 A1 Nov. 2, 2017

(30) Foreign Application Priority Data

Apr. 27, 2016 (JP) ..... 2016-088871
Apr. 27, 2016 (JP) ..... 2016-088874

(51) Int. Cl.
*B65H 3/44* (2006.01)
*B65H 7/02* (2006.01)
*G03G 15/00* (2006.01)

(52) U.S. Cl.
CPC ..... *G03G 15/6564* (2013.01); *B65H 3/44* (2013.01); *B65H 7/02* (2013.01); *G03G 15/6508* (2013.01); *G03G 15/6561* (2013.01); *B65H 2513/50* (2013.01); *B65H 2557/63* (2013.01); *B65H 2701/1311* (2013.01)

(58) Field of Classification Search
CPC ..... G03G 15/6561; G03G 15/6508; G03G 15/6564; B65H 3/44; B65H 7/02; B65H 2513/50; B65H 2557/63; B65H 2701/1311
See application file for complete search history.

(56) References Cited

U.S. PATENT DOCUMENTS 9,624,054 B2 4/2017 Iino
2003/0059229 A1 3/2003 Yamamoto et al. ..... 399/109
(Continued)

FOREIGN PATENT DOCUMENTS

JP H 02-204239 A 8/1990
JP H 11-139624 A 5/1999
(Continued)

OTHER PUBLICATIONS

Japanese Office Action dated Nov. 20, 2018, issued to the corresponding Japanese Application No. 2016-088874.

*Primary Examiner* — David H Banh
(74) *Attorney, Agent, or Firm* — Stein IP, LLC

(57) ABSTRACT

An image forming apparatus includes a registration unit, a first paper feeding unit, a second paper feeding unit, and a control unit, which performs a primary paper feeding for conveying a paper sheet to a registration position, finishes the primary paper feeding at timing when the paper sheet reaches the registration position, and then after operating a target paper feeding unit until a preceding feeding time elapses, performs a secondary paper feeding for conveying the paper sheet to the printing position. The control unit sets different values of the preceding feeding time for the case where the first paper feeding unit is the target paper feeding unit and the case where the second paper feeding unit is the target paper feeding unit.

8 Claims, 13 Drawing Sheets

(56) References Cited

U.S. PATENT DOCUMENTS

| | | | | |
|---|---|---|---|---|
| 2008/0246977 | A1* | 10/2008 | Fujii | B41J 11/003 358/1.2 |
| 2009/0142088 | A1* | 6/2009 | Tanaka | G03G 15/234 399/76 |
| 2012/0207485 | A1* | 8/2012 | Iwakawa | G03G 15/0189 399/16 |
| 2013/0308992 | A1* | 11/2013 | Suzuki | G03G 15/16 399/341 |
| 2014/0167351 | A1* | 6/2014 | Inoue | B65H 3/44 271/234 |
| 2016/0039625 | A1 | 2/2016 | Iino | B65H 7/20 |
| 2016/0295058 | A1* | 10/2016 | Yoshihara | H04N 1/00994 |

FOREIGN PATENT DOCUMENTS

| | | | |
|---|---|---|---|
| JP | 2003-195593 | A | 7/2003 |
| JP | 2005-104717 | A | 7/2003 |
| JP | 2010-211119 | A | 9/2010 |
| JP | 2016-37370 | A | 3/2016 |

* cited by examiner

FIG.7

| PAPER FEEDING UNIT | PAPER LENGTH (mm) | PRECEDING FEEDING TIME (ms) |
|---|---|---|
| FIRST PAPER FEEDING UNIT | — | 90 |
| SECOND PAPER FEEDING UNIT | ~200 (THRESHOLD VALUE) | 110 |
| | 201~ | 100 |

FIG.8

| PAPER FEEDING UNIT | OPERATING TIME (min) | PAPER LENGTH (mm) | PRECEDING FEEDING TIME (ms) |
|---|---|---|---|
| FIRST PAPER FEEDING UNIT | ~10000 (THRESHOLD VALUE) | — | 90 |
| | 10001~ | — | 100 |
| SECOND PAPER FEEDING UNIT | ~10000 (THRESHOLD VALUE) | ~200 (THRESHOLD VALUE) | 110 |
| | | 201~ | 100 |
| | 10001~ | ~200 (THRESHOLD VALUE) | 120 |
| | | 201~ | 110 |

| WAITING TIME (ms) | TIME DIFFERENCE (ms) |
|---|---|
| 0～50 | 0 |
| 51～100 | 45 |
| 101～ | 90 |

IMAGE FORMING APPARATUS

INCORPORATION BY REFERENCE

This application is based upon and claims the benefit of priority from the corresponding Japanese Patent Applications No. 2016-088871 and No. 2016-088874 filed Apr. 27, 2016, the entire contents of which are hereby incorporated by reference.

BACKGROUND

The present disclosure relates to an image forming apparatus that prints an image on a paper sheet.

Conventionally, there is known an image forming apparatus in which a paper sheet is conveyed along a paper conveying path, and an image is printed on the paper sheet that is being conveyed.

The conventional image forming apparatus is equipped with a paper feeding unit such as a paper feed roller, which feeds a paper sheet stored in a paper cassette to a paper conveying path so as to convey the paper sheet to a registration position. In addition, a registration unit such as a registration roller is disposed at the registration position so as to convey the paper sheet from the registration position to a printing position. Then, an image forming unit prints an image on the paper sheet that is being conveyed when the paper sheet passes the printing position.

SUMMARY

An image forming apparatus according to a first aspect of the present disclosure includes a paper conveying path, a registration unit, a first paper feeding unit, a second paper feeding unit, and a control unit. The paper conveying path is for conveying a paper sheet to a printing position via a registration position. The registration unit operates to convey the paper sheet after reaching the registration position to the printing position. The first paper feeding unit operates to convey the paper sheet to the registration position. The second paper feeding unit operates to convey the paper sheet to the registration position. The control unit selects one of the first paper feeding unit and the second paper feeding unit as a target paper feeding unit for conveying the paper sheet to be printed, sets a preceding feeding time, performs a primary paper feeding in which the registration unit is not operated but the target paper feeding unit is operated so that the paper sheet is conveyed to the registration position, finishes the primary paper feeding at timing when the paper sheet reaches the registration position, and then after operating the target paper feeding unit without operating the registration unit until the preceding feeding time elapses, performs a secondary paper feeding in which the registration unit is operated so that the paper sheet after reaching the registration position is conveyed to the printing position. The control unit sets different values of the preceding feeding time for the case where the first paper feeding unit is the target paper feeding unit and the case where the second paper feeding unit is the target paper feeding unit.

An image forming apparatus according to a second aspect of the present disclosure includes a paper conveying path, a paper feeding unit, a registration unit, an image forming unit, and a control unit. The paper conveying path is for conveying a paper sheet from a paper feeding position to a printing position via a registration position placed above the paper feeding position. The paper feeding unit operates to convey the paper sheet from the paper feeding position to the registration position. The registration unit operates to convey the paper sheet after reaching the registration position to the printing position. The image forming unit forms an image to be printed on the paper sheet and prints the image on the paper sheet conveyed to the printing position. The control unit performs a primary paper feeding in which the registration unit is not operated but the paper feeding unit is operated so that the paper sheet is conveyed from the paper feeding position to the registration position, finishes the primary paper feeding at a predetermined time after the paper sheet reaches the registration position, and then after a printing preparation is done for printing the image on the paper sheet, performs a secondary paper feeding in which the registration unit and the paper feeding unit are operated so that the paper sheet after reaching the registration position is conveyed to the printing position. The control unit measures waiting time after the primary paper feeding is finished until the printing preparation is done. When the printing preparation is done, if the measured time as the waiting time is longer than a predetermined threshold time, the control unit starts to operate the paper feeding unit first, and then starts to operate the registration unit while continuing the operation of the paper feeding unit, so as to start the secondary paper feeding. If the measured time is the threshold time or less, the control unit starts to operate both the paper feeding unit and the registration unit at the same time, so as to start the secondary paper feeding.

BRIEF DESCRIPTION OF THE DRAWINGS

FIG. 7 is a table showing an execution time of preceding paper feeding (preceding feeding time) performed in the image forming apparatus according to the first embodiment of the present disclosure.

FIG. 8 is a table showing the execution time of the preceding paper feeding (the preceding feeding time) performed in the image forming apparatus according to the first embodiment of the present disclosure.

DETAILED DESCRIPTION

Hereinafter, an image forming apparatus according to an embodiment of the present disclosure is described with an example of a laser printer.

First Embodiment

<Structure of Image Forming Apparatus>

Figure 1:
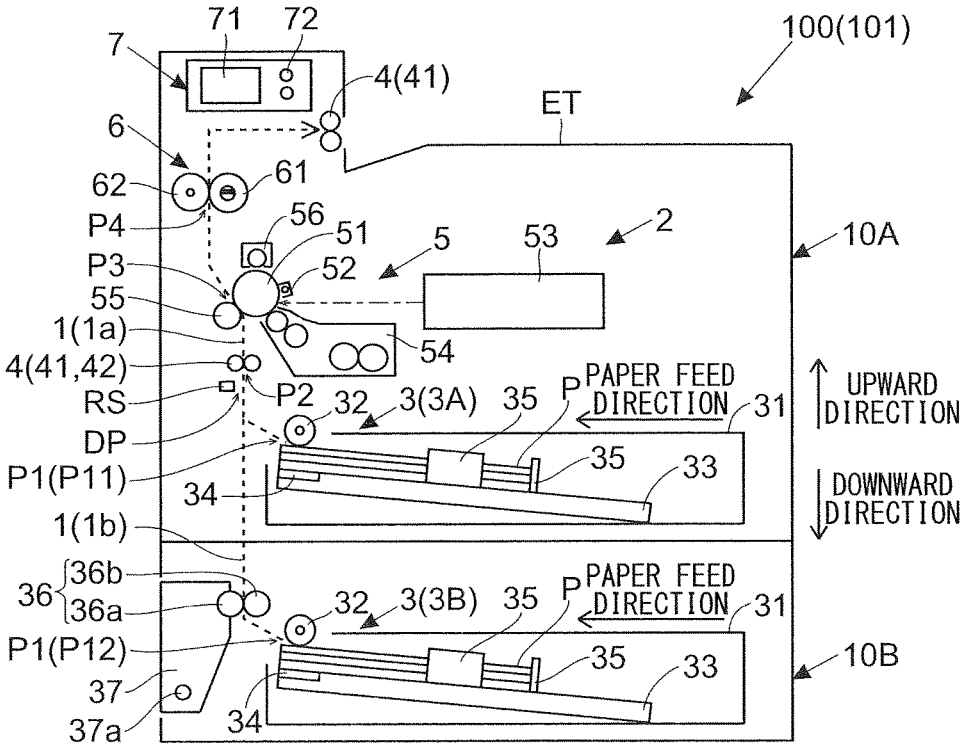
FIG. 1 is a diagram illustrating an overall structure of an image forming apparatus according to a first embodiment of the present disclosure.

As illustrated in FIG. 1, an image forming apparatus 100 (101) of a first embodiment has a paper conveying path 1 (shown by a broken line) for conveying a paper sheet P. This paper conveying path 1 extends from a paper feeding position P1 to a discharge tray ET via a registration position P2, a printing position P3, and a fixing position P4 in this order. Here, the registration position P2 is positioned above the paper feeding position P1, the printing position P3 is positioned above the registration position P2, and the fixing position P4 is positioned above the printing position P3. In other words, the paper conveying path 1 is formed to extend from the lower part to the upper part in the apparatus main body (the paper sheet P is vertically conveyed). Note that a part of the paper conveying path 1, which extends from the downstream position of the paper feeding position P1 in the conveying direction to the registration position P2, is formed to extend in a substantially vertical direction (in an up and down direction).

In addition, the image forming apparatus 101 includes a printing unit 2 that feeds the paper sheet P to the paper conveying path 1 to convey the same and prints an image on the paper sheet P that is being conveyed. This printing unit 2 is constituted of a paper feeding unit 3 (a first paper feeding unit 3A and a second paper feeding unit 3B), a paper conveying unit 4, an image forming unit 5 and a fixing unit 6.

The paper feeding unit 3 includes a paper cassette 31 and a paper feed roller 32, feeds the paper sheet P to the paper conveying path 1, and conveys the paper sheet P along the paper conveying path 1. The paper cassette 31 stores the paper sheets P to be used for printing. This paper cassette 31 is disposed at the lower part of the image forming apparatus 100 and is attachable and detachable with respect to the image forming apparatus 100. Further, when the paper cassette 31 runs out of the paper sheets P, the paper cassette 31 is drawn out of the image forming apparatus 100, and the paper sheets P are supplied to the paper cassette 31.

In the paper cassette 31, there is disposed a lift plate 33 that can move in the up and down direction. Further, the paper sheets P in the paper cassette 31 are placed on the lift plate 33. The lift plate 33 is supported by walls of the paper cassette 31 so as to pivot at an upstream side end in a paper feed direction. For example, although not illustrated, the lift plate 33 moves (rotates) upward by a biasing force of a biasing member such as a spring. Alternatively, the lift plate 33 moves (rotates) upward by a drive force from a motor. In addition, a friction pad 34 made of cork or rubber is disposed on the upper surface of the lift plate 33 at a downstream side end in the paper feed direction.

In addition, the paper cassette 31 is provided with a regulating guide 35 that abuts sides of the paper sheets P so as to position the paper sheets P. This regulating guide 35 is slidable, and a size (conveying direction length) of the paper sheets P that can be stored in the paper cassette 31 is changed by sliding the regulating guide 35. Note that the regulating guide 35 includes a first cursor for positioning in a width direction of the paper sheet P (perpendicular to the paper feed direction) and a second cursor for positioning the rear edge of the paper sheet P.

The paper feed roller 32 is disposed at the paper feeding position P1 (feed port of the paper sheet P in the paper conveying path 1). Further, the lift plate 33 is disposed below the paper feed roller 32 so that the downstream side end thereof in the paper feed direction (the friction pad 34) faces the paper feed roller 32. Therefore, when the lift plate 33 moves upward, the downstream side end of the lift plate 33 in the paper feed direction becomes close to the paper feed roller 32 so that the top paper sheet P among a plurality of paper sheets P placed on the lift plate 33 contacts with the paper feed roller 32. In other words, the plurality of paper sheets P are sandwiched between the paper feed roller 32 and the friction pad 34. Note that, although not illustrated, the paper feed roller 32 is biased toward the lift plate 33 (biased downward) by a biasing member such as a spring.

For example, the paper sheets P are set in the paper cassette 31, and the paper cassette 31 is attached to the image forming apparatus 100. Then, the lift plate 33 moves upward, and the top one of the paper sheets P on the lift plate 33 contacts with the paper feed roller 32. In other words, the paper feed roller 32 always contacts with the top one of the paper sheets P on the lift plate 33. Note that, if there is no paper sheet P on the lift plate 33, the paper feed roller 32 contacts with a paper sheet placing surface (upside) of the lift plate 33.

When feeding the paper sheet P to the paper conveying path 1, the paper feed roller 32 rotates (the paper feeding unit 3 operates) in the state where the top one of the paper sheets P on the lift plate 33 contacts with the paper feed roller 32. When the paper feed roller 32 rotates, the top one of the paper sheets P on the lift plate 33 is drawn out and is fed to the paper conveying path 1 (sent in the paper feed direction). In other words, the paper sheet P is conveyed from the paper feeding position P1 to the registration position P2. In this case, because the bottom paper sheet P on the lift plate 33 contacts with the friction pad 34, the bottom paper sheet P is hardly displaced, and firmness of the paper sheet bundle (the bundle of the plurality of paper sheets P on the lift plate 33) is secured.

Here, in the first embodiment, an optional sheet feeding device 10B is additionally attached to an apparatus main body 10A of the image forming apparatus 101. In the structure of the apparatus main body 10A to which the optional sheet feeding device 10B is attached, the paper conveying path 1 (1*a*) formed in the apparatus main body 10A and the paper conveying path 1 (1*b*) formed in the optional sheet feeding device 10B are connected to each other.

In addition, in the structure of the apparatus main body 10A to which the optional sheet feeding device 10B is attached, the paper feeding unit 3 is separated into the first paper feeding unit 3A and the second paper feeding unit 3B. The first paper feeding unit 3A is a paper feeding unit of the apparatus main body 10A (a paper feeding unit that is normally provided to the apparatus main body 10A), and the second paper feeding unit 3B is a paper feeding unit of the optional sheet feeding device 10B. Note that the paper feeding position P1 of the first paper feeding unit 3A is denoted by P11, and the paper feeding position P1 of the second paper feeding unit 3B is denoted by P12 in FIG. 1.

For example, the optional sheet feeding device 10B is attached to the lower part of the apparatus main body 10A. Therefore, the second paper feeding unit 3B is positioned below the first paper feeding unit 3A. Further, the first paper feeding unit 3A conveys the paper sheet P from the paper feeding position P11 to the registration position P2. The second paper feeding unit 3B conveys the paper sheet P from the paper feeding position P12 positioned below the paper feeding position P11 to the registration position P2.

The first paper feeding unit 3A and the second paper feeding unit 3B have substantially the same structure. In other words, each of the first paper feeding unit 3A and the second paper feeding unit 3B includes the paper cassette 31, the paper feed roller 32, the lift plate 33, the friction pad 34, and the regulating guide 35. However, the second paper feeding unit 3B further includes an intermediate roller pair 36 unlike the first paper feeding unit 3A.

The intermediate roller pair 36 is disposed in the paper conveying path 1*b* of the optional sheet feeding device 10B. Specifically, the intermediate roller pair 36 is disposed at a position on the downstream side in the conveying direction of the paper feed roller 32 of the second paper feeding unit 3B. In this structure, the paper feed roller 32 corresponds to an "upstream side roller unit", and the intermediate roller pair 36 corresponds to a "downstream side roller unit".

The intermediate roller pair 36 is a pair of rollers 36*a* and 36*b* that are pressed to contact with each other. The one roller 36*a* is attached to an open/close cover 37. Note that the open/close cover 37 is a cover that is attached in a rotatable (openable and closable) manner about a rotation shaft 37*a*. When this open/close cover 37 is opened, the inside of the paper conveying path 1*b* of the optional sheet feeding device 10B can be exposed. Therefore, if jamming (paper jam) occurs, a user opens the open/close cover 37 to perform unjamming treatment.

In the case where the one roller 36*a* is attached to the open/close cover 37, when the open/close cover 37 is opened, the one roller 36*a* moves to separate from the other roller 36*b*. Therefore, if jamming occurs, by opening the open/close cover 37, the intermediate roller pair 36 nipping the paper sheet P is released, and hence the paper sheet P can be easily taken out. Then, when the open/close cover 37 is closed, the one roller 36*a* is pressed to contact with the other roller 36*b*.

Note that the smallest length in the conveying direction of the paper sheet P that can be fed by the first paper feeding unit 3A is equal to or more than the conveying distance of the paper sheet P from the paper feeding position P11 to the registration position P2 (for example, it is the conveying distance plus a margin). In addition, the smallest length in the conveying direction of the paper sheet P that can be fed by the second paper feeding unit 3B is equal to or more than the conveying distance of the paper sheet P from the position of the intermediate roller pair 36 to the registration position P2 (for example, the conveying distance plus a margin).

The paper conveying unit 4 includes a plurality of conveying roller pairs 41, so as to convey the paper sheet P along the paper conveying path 1. The plurality of conveying roller pairs 41 are disposed in the paper conveying path 1*a* of the apparatus main body 10A. Here, among the plurality of conveying roller pairs 41, the conveying roller pair 41 disposed at the registration position P2 is a registration roller pair (hereinafter denoted by 42). Note that the registration roller pair 42 corresponds to a "registration unit".

The registration roller pair 42 is stopped to rotate (operate) at a time point when the paper sheet P reaches the registration position P2. Then, after the paper sheet P reaches the registration position P2, the registration roller pair 42 rotates. In this way, the paper sheet P that has reached the registration position P2 is conveyed to the printing position P3.

The image forming unit 5 includes a photosensitive drum 51, an electrifying device 52, an exposing device 53, a developing device 54, a transfer roller 55, and a cleaning device 56. Further, the image forming unit 5 forms a toner image (image) based on image data of an image to be printed and transfers (prints) the toner image onto the paper sheet P that is conveyed to the printing position P3.

When the toner image is formed, the photosensitive drum 51 rotates, and the electrifying device 52 electrifies the surface of the photosensitive drum 51 at a predetermined potential. In addition, the exposing device 53 includes a light emitting element (not shown) that emits a light beam for exposure, so as to scan and expose the surface of the photosensitive drum 51 while turning on and off the light emitting element. In this way, an electrostatic latent image is formed on the surface of the photosensitive drum 51. The developing device 54 supplies toner to the electrostatic latent image formed on the surface of the photosensitive drum 51 so as to develop the electrostatic latent image into a toner image.

The transfer roller 55 is pressed to contact with the surface of the photosensitive drum 51 so that a transfer nip is formed between the transfer roller 55 and the photosensitive drum 51 at the printing position P3. Further, when the paper sheet P passes through this transfer nip, the toner image on the surface of the photosensitive drum 51 is transferred onto the paper sheet P. The cleaning device 56 removes toner and the like remaining on the surface of the photosensitive drum 51.

The fixing unit 6 includes a fixing roller pair (a heating roller 61 and a pressure roller 62), so as to heat and press the toner image on the paper sheet P for fixing the toner image. The heating roller 61 includes a built-in heat source. The pressure roller 62 is pressed to contact with the heating roller 61 so that a fixing nip is formed between the pressure roller 62 and the heating roller 61 at the fixing position P4. Further, when the paper sheet P passes through this fixing nip, the toner image on the paper sheet P is fixed. After that, the paper sheet P goes out of the fixing unit 6 and is discharged onto the discharge tray ET.

Note that the image forming apparatus 101 is equipped with an operation panel 7. The operation panel 7 includes a display unit 71 and an operation unit 72. The display unit 71 is constituted of a liquid crystal display panel and displays a message indicating a status of the image forming apparatus 101, and the like. The operation unit 72 is constituted of hardware keys and the like so as to receive various settings from the user.

Figure 2:
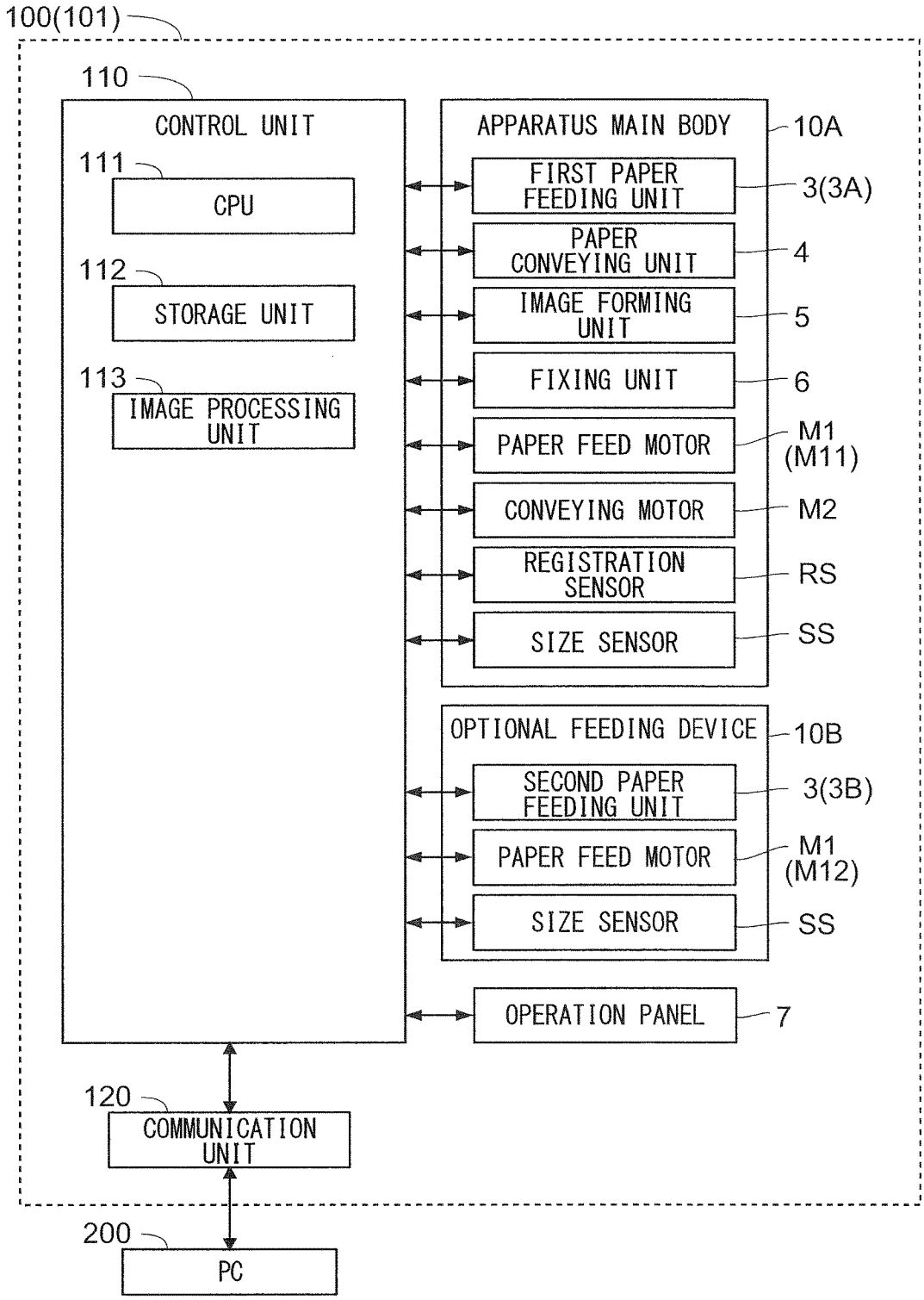
FIG. 2 is a diagram illustrating a hardware structure of the image forming apparatus according to the first embodiment of the present disclosure.

In addition, the image forming apparatus 101 includes a control unit 110 as illustrated in FIG. 2. The control unit 110 includes a CPU 111, a storage unit 112 (memories such as a ROM and a RAM), and an image processing unit 113.

The CPU 111 operates based on control programs and data so as to control individual portions of the first paper feeding unit 3A and the second paper feeding unit 3B. In addition, the control unit 110 controls individual portions of the paper conveying unit 4, the image forming unit 5, and the fixing unit 6. Further, the control unit 110 controls the operation panel 7. The control programs and data are stored in the storage unit 112 (are stored in the ROM in advance and are loaded into the RAM).

The image processing unit 113 includes, for example, an image processing circuit, an image processing memory, and the like. Further, the image processing unit 113 performs image processing such as scaling and density conversion on the image data. In addition, the image processing unit 113 performs image processing for converting the image data to be processed into image data for exposure (data for turning on and off the light emitting element of the exposing device 53).

In addition, the control unit 110 is connected to a communication unit 120. The communication unit 120 is connected to a personal computer (PC) 200 as a user terminal that is used by the user of the image forming apparatus 100. The PC 200 transmits an instruction to execute a print job, image data of an image to be printed, job data including a job execution condition, and the like. For example, the job data includes information indicating the paper cassette 31 designated by the user (hereinafter may be referred to as a designated cassette 31), information indicating a paper sheet size designated by the user, and the like. When the communication unit 120 receives the job data, the control unit 110 determines that it has received the instruction to execute a print job from the user. Then, the control unit 110 executes the print job based on the job data.

Here, the control unit 110 controls to drive motors for various rotating members for conveying the paper sheet P and controls the operation for conveying the paper sheet P when the job is executed. The motors include, for example, paper feed motors M1 (M11 and M12) and a conveying motor M2.

The paper feed motor M11 is a motor for rotating (operating) the paper feed roller 32 of the first paper feeding unit 3A. For example, the paper feed roller 32 of the first paper feeding unit 3A rotates when receiving a drive force from the paper feed motor M11 via a paper feed clutch (not shown). Then, the control unit 110 controls on and off of the paper feed clutch so as to switch the paper feed roller 32 of the first paper feeding unit 3A between rotation and stop.

The paper feed motor M12 is a motor for rotating (operating) each of the paper feed roller 32 and the intermediate roller pair 36 of the second paper feeding unit 3B. For example, the paper feed roller 32 of the second paper feeding unit 3B rotates when receiving a drive force from the paper feed motor M12 via the paper feed clutch (not shown). Then, the control unit 110 controls on and off of the paper feed clutch so as to switch the paper feed roller 32 of the second paper feeding unit 3B between rotation and stop. Using this paper feed clutch, it is possible to rotate the intermediate roller pair 36 in a state where the paper feed roller 32 of the second paper feeding unit 3B is stopped to rotate.

The conveying motor M2 is a motor for rotating (operating) the plurality of conveying roller pairs 41. For example, among the plurality of conveying roller pairs 41, the registration roller pair 42 rotates when receiving the drive force from the conveying motor M2 via a registration clutch (not shown). Then, the control unit 110 controls on and off of the registration clutch so as to switch the registration roller pair 42 between rotation and stop. In this way, because the conveying motor M2 and the registration roller pair 42 are connected via the registration clutch, it is possible to rotate the other conveying roller pair 41 in a state where the registration roller pair 42 is stopped to rotate. Note that the photosensitive drum 51 and the transfer roller 55 are also rotating members for conveying the paper sheet P, and these rotating members may also be rotated by the conveying motor M2.

In addition, the control unit 110 is connected to a registration sensor RS for detecting presence or absence of the paper sheet P at a position DP before the registration position P2 (see FIG. 1). The registration sensor RS is a sensor that changes its output value in accordance with presence or absence of the paper sheet P at the detection position DP. Further, the control unit 110 detects presence or absence of the paper sheet P at the detection position DP (arrival of the front edge of the paper sheet P and passage of the rear end of the same) based on an output value of the registration sensor RS. For example, based on a result of the detection, the control unit 110 determines whether or not the front edge of the paper sheet P has reached the registration position P2.

Further, the control unit 110 is connected to a size sensor SS for detecting a size of the paper sheets P stored in the paper cassette 31. The size sensor SS is a sensor that changes its output value in accordance with a position of the regulating guide 35. Further, on the basis of an output value of the size sensor SS, the control unit 110 detects a size (conveying direction length) of the paper sheets P stored in the paper cassette 31 attached to each of the apparatus main body 10A and the optional sheet feeding device 10B.

<Primary Paper Feeding and Secondary Paper Feeding>

When the control unit 110 receives the instruction to execute a print job (When the communication unit 120 receives job data), the control unit 110 performs image processing (such as conversion into the image data for exposure) on the image data. In addition, the control unit 110 recognizes the designated cassette 31 based on the job data. For example, the control unit 110 recognizes the paper cassette 31 storing the paper sheets P of the paper sheet size designated by the user, as the designated cassette 31. Then, the control unit 110 selects the paper feeding unit 3, from the first paper feeding unit 3A and the second paper feeding unit 3B, for feeding the paper sheet P in the designated cassette 31 (the paper sheet P to be printed) to the paper conveying path 1 so as to convey the same, as the paper feeding unit to be operated when executing the job. Hereinafter, the paper feeding unit selected by the control unit 110 is referred to as a target paper feeding unit 3.

When selecting the target paper feeding unit 3, the control unit 110 sets the preceding feeding time. Further, the control unit 110 performs the primary paper feeding. After that, the control unit 110 performs secondary paper feeding. Hereinafter, with reference to timing charts illustrated in FIGS. 3 and 4, the primary paper feeding and the secondary paper feeding are described.

Figure 3:
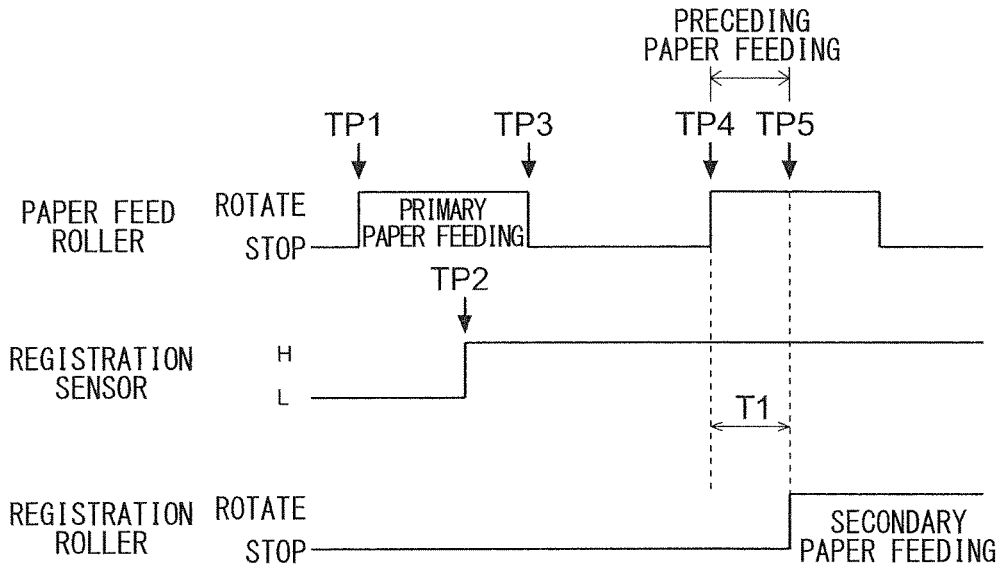
FIG. 3 is a timing chart for explaining a paper conveying operation (of a first paper feeding unit) of the image forming apparatus according to the first embodiment of the present disclosure.

First, with reference to FIG. 3, a case where the first paper feeding unit 3A is selected as the target paper feeding unit 3 is described. When receiving the instruction to execute a print job (time point TP1), the control unit 110 starts the primary paper feeding. In this case, the control unit 110 drives the paper feed motor M11 so as to rotate the paper feed roller 32 of the first paper feeding unit 3A. In addition, the control unit 110 drives the conveying motor M2 so as to rotate the plurality of conveying roller pairs 41. However, the control unit 110 turns off the registration clutch. In other words, the control unit 110 does not drive the registration roller pair 42 to rotate but drives only the other conveying roller pair 41 to rotate.

When the paper feed roller 32 of the first paper feeding unit 3A rotates, the paper sheet P in the designated cassette 31 is fed to the paper conveying path 1, and the paper sheet P is conveyed along the paper conveying path 1. Then, the front edge of the paper sheet P reaches the detection position DP (time point TP2). In this way, the output value of the registration sensor RS changes from L level indicating absence of the paper sheet P to H level indicating presence of the paper sheet P. In other words, the control unit 110 detects that the front edge of the paper sheet P has reached the detection position DP.

After detecting that the front edge of the paper sheet P has reached the detection position DP, when time necessary for the paper sheet P to travel the distance between the detection position DP and the registration position P2 elapses (TP3), the control unit 110 stops rotation of the paper feed roller 32 and finishes the primary paper feeding. In other words, the control unit 110 finishes the primary paper feeding at the timing when the front edge of the paper sheet P reaches the registration position P2. Note that it is possible to finish the primary paper feeding just before the front edge of the paper sheet P reaches the registration position P2 (it is not necessary that the front edge of the paper sheet P reaches the registration position P2 at the time point when the primary paper feeding is finished).

After finishing the primary paper feeding, the control unit 110 determines whether or not printing preparation for printing an image on the paper sheet P is done. For example, the control unit 110 determines that the printing preparation is done if the image processing on the image data of an image to be printed on the paper sheet P is completed so that the exposing device 53 is ready to expose the photosensitive drum 51 (to form an electrostatic latent image).

When the printing preparation is done (time point TP4), the control unit 110 drives the paper feed roller 32 to rotate. In this case, the control unit 110 turns off the registration clutch and maintains its state (does not drive the registration roller pair 42 to rotate). In other words, at the time point when the printing preparation is done, conveyance of the paper sheet P from the registration position P2 to the printing position P3 is not started.

When rotating the paper feed roller 32 first without rotating the registration roller pair 42, the front edge of the paper sheet P is pressed to the registration roller pair 42 that is stopped to rotate, and hence a skew of the paper sheet P is corrected. In this case, a deflection is formed in the front edge part of the paper sheet P.

Next, when a preceding feeding time T1 elapses after rotation start of the paper feed roller 32 (time point TP5), the control unit 110 turns on the registration clutch so that the registration roller pair 42 rotates. In other words, the control unit 110 starts the secondary paper feeding. In this way, a part of the paper sheet P after reaching the registration position P2, which remains at the paper feeding position P1, is sent out by the paper feed roller 32 in the paper feed direction, and the front edge of the paper sheet P enters the nip of the registration roller pair 42. Then, the paper sheet P that has entered the nip of the registration roller pair 42 is conveyed by the registration roller pair 42 to the printing position P3 (the secondary paper feeding is performed). After starting the secondary paper feeding, the control unit 110 starts the exposure of the photosensitive drum 51 by the exposing device 53 (the formation of the electrostatic latent image).

Further, when a predetermined time elapses from the rotation start of the registration roller pair 42, the control unit 110 turns off the paper feed clutch so as to stop the rotation of the paper feed roller 32. This rotation stop of the paper feed roller 32 is performed before the rear edge of the paper sheet P passes the position of the paper feed roller 32, in order to prevent double feeding of the paper sheets P. Note that, even if the rotation of the paper feed roller 32 is stopped before the rear edge of the paper sheet P passes the position of the paper feed roller 32, the paper sheet P has already entered the nip of the registration roller pair 42, and hence the registration roller pair 42 continues to convey the paper sheet P.

Figure 4:
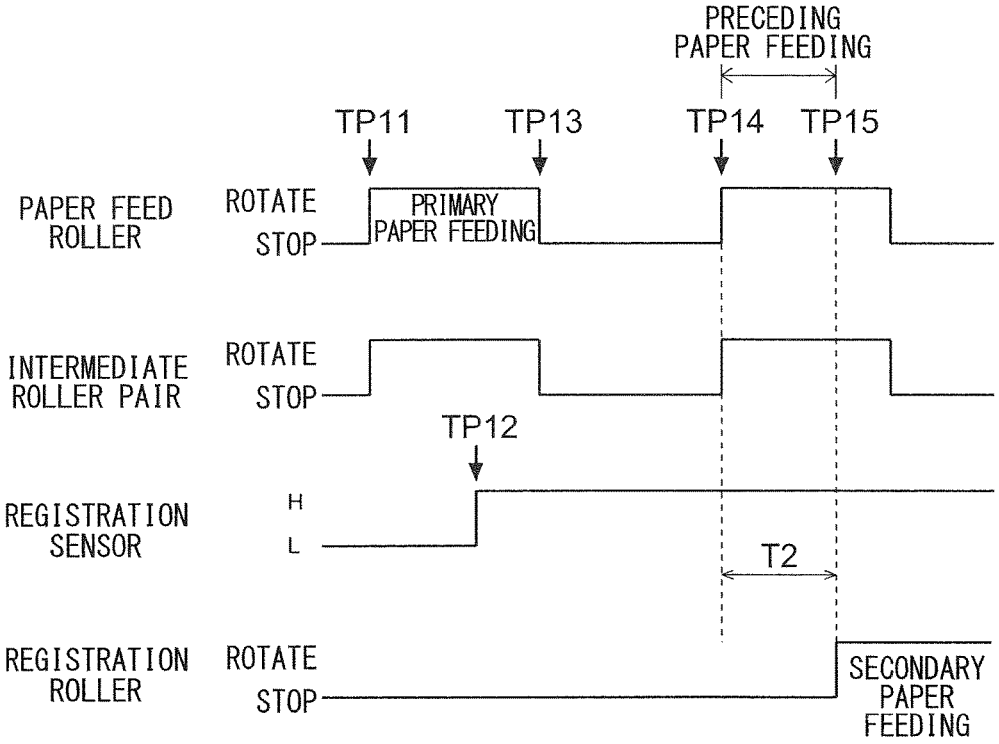
FIG. 4 is a timing chart for explaining the paper conveying operation (of a second paper feeding unit) of the image forming apparatus according to the first embodiment of the present disclosure.

Next, with reference to FIG. 4, the case where the second paper feeding unit 3B is selected as the target paper feeding unit 3 is described. When receiving the instruction to execute a print job (time point TP11), the control unit 110 drives the paper feed motor M12 for starting the primary paper feeding, so as to rotate the paper feed roller 32 of the second paper feeding unit 3B and the intermediate roller pair 36. In addition, the control unit 110 drives the conveying motor M2 in the state where the registration clutch is turned off, so as to rotate the conveying roller pair 41 that is other than the registration roller pair 42. In this way, the front edge of the paper sheet P reaches the detection position DP (time point TP12).

After it is detected that the front edge of the paper sheet P has reached the detection position DP, when the time necessary for the paper sheet P to travel the distance between the detection position DP and the registration position P2 elapses (TP13), i.e., when the front edge of the paper sheet P reaches the registration position P2, the control unit 110 stops to rotate the paper feed roller 32 and the intermediate roller pair 36 so as to finish the primary paper feeding. Note that if the conveying direction length of the paper sheet P is short (if the rear edge of the paper sheet P passes the position of the paper feed roller 32 before the primary paper feeding is finished), even before the primary paper feeding is finished, rotation of the paper feed roller 32 is stopped before the rear edge of the paper sheet P passes the position of the paper feed roller 32 in order to prevent the double feeding of the paper sheets P. However, the intermediate roller pair 36 is continued to rotate until the front edge of the paper sheet P reaches the registration position P2.

After the primary paper feeding is finished, when the printing preparation is done (time point TP14), the control unit 110 drives the paper feed roller 32 and the intermediate roller pair 36 to rotate. However, if the rotation of the paper feed roller 32 is stopped before the primary paper feeding is finished (if the conveying direction length of the paper sheet P is short), the control unit 110 does not drive the paper feed roller 32 to rotate but drives the intermediate roller pair 36 to rotate. In this way, a skew of the paper sheet P is corrected (a deflection is formed in the front edge part of the paper sheet P).

Next, a preceding feeding time T2 passes from the rotation start of the paper feed roller 32 (or the intermediate roller pair 36) (time point TP15), the control unit 110 turns on the registration clutch so that the registration roller pair 42 rotates, for starting the secondary paper feeding. In this way, the paper sheet P that has reached the registration position P2 is conveyed to the printing position P3 (the secondary paper feeding is performed).

In the first embodiment, as illustrated in FIGS. 3 and 4, when the secondary paper feeding is performed, the paper feeding operation by the paper feeding unit 3 is first started. In other words, if the first paper feeding unit 3A is the target paper feeding unit 3, the rotation of the paper feed roller 32 is first started, and if the second paper feeding unit 3B is the target paper feeding unit 3, rotation of the paper feed roller 32 and rotation of the intermediate roller pair 36 (or rotation of the intermediate roller pair 36) is first started. Then, after that (after a skew of the paper sheet P is corrected), rotation of the registration roller pair 42 is started (the secondary paper feeding is started). Hereinafter, the control of starting the paper feeding operation by the paper feeding unit 3 prior to the start of the secondary paper feeding may be referred to as preceding paper feeding.

<Setting of Preceding Feeding Time>

Figure 5:
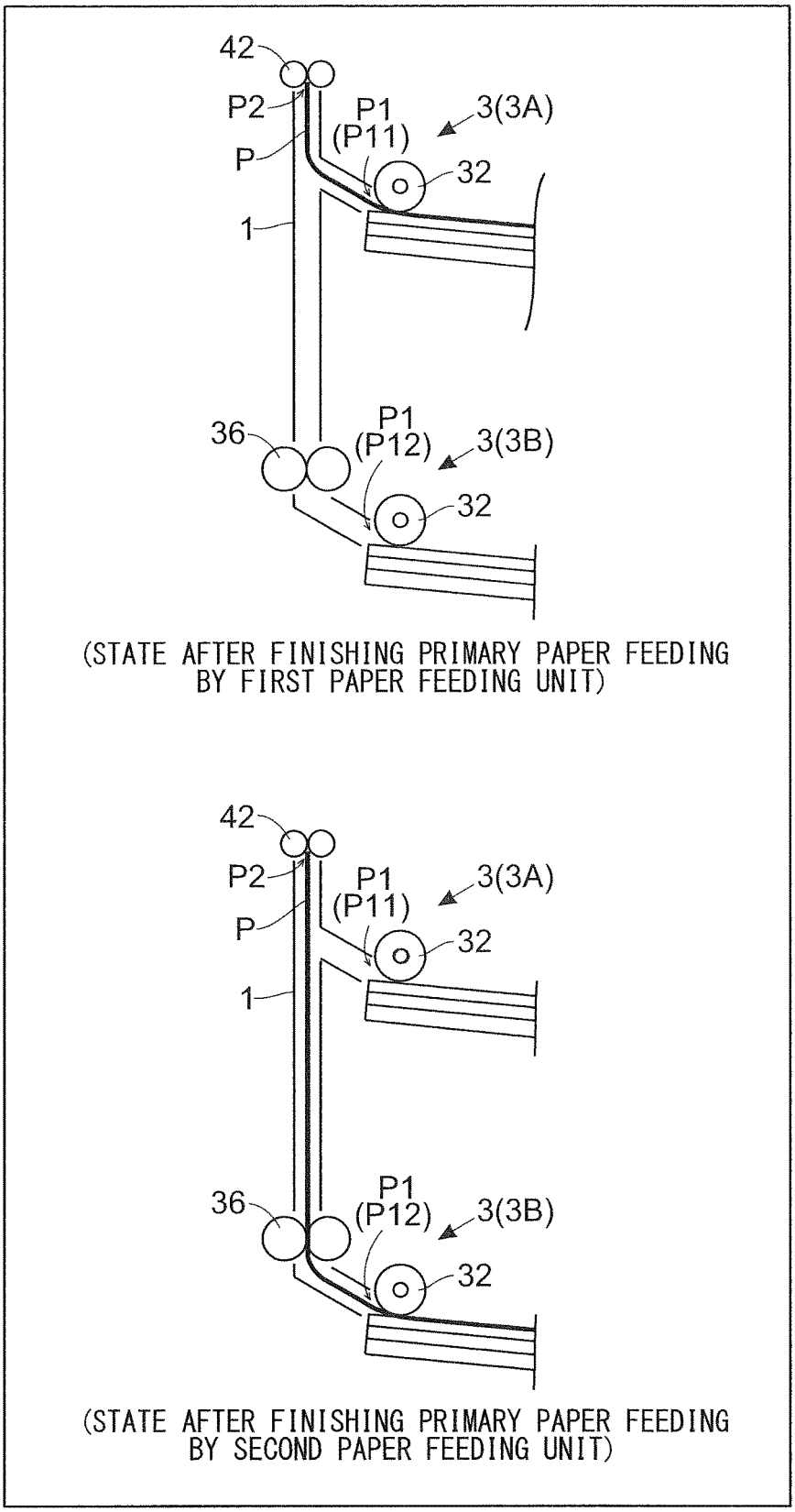
FIG. 5 is a diagram illustrating a paper sheet position at a time point when primary paper feeding is finished in the image forming apparatus according to the first embodiment of the present disclosure.

As illustrated in FIG. 5, at a time point when the primary paper feeding is finished (a time point just before the preceding paper feeding is started), a part of the paper sheet P on the conveying direction downstream side of the intermediate roller pair 36 of the second paper feeding unit 3B (see the lower part in FIG. 5) becomes larger than a part of the paper sheet P on the conveying direction downstream side of the paper feed roller 32 of the first paper feeding unit 3A (see the upper part in FIG. 5). Therefore, in the preceding paper feeding in the case where the second paper feeding unit 3B is the target paper feeding unit 3, the paper feed roller pair 32 or the intermediate roller pair 36 easily slips on the paper sheet P. If the paper feed roller pair 32 or the intermediate roller pair 36 slips, the correction of a skew of the paper sheet P becomes insufficient.

In order to prevent occurrence of this inconvenience, out of the first paper feeding unit 3A and the second paper feeding unit 3B, the paper feeding unit that is more apt to slip on the paper sheet P when the preceding paper feeding is performed is determined in an experimental manner or a simulating manner. In this embodiment, the second paper feeding unit 3B is determined to be the paper feeding unit that is apt to slip on the paper sheet P when the preceding paper feeding is performed.

Further, the control unit 110 sets the preceding feeding time in the case where the second paper feeding unit 3B is the target paper feeding unit 3 (corresponding to the time T2 illustrated in FIG. 4) to be longer than the preceding feeding time in the case where the first paper feeding unit 3A is the target paper feeding unit 3 (corresponding to the predetermined time T1 illustrated in FIG. 3). In this way, in the case where the second paper feeding unit 3B is the target paper feeding unit 3, time for correcting a skew of the paper sheet P (time for forming deflection in the front edge part of the paper sheet P) is set to be longer than in the case where the first paper feeding unit 3A is the target paper feeding unit 3. However, in the case where the second paper feeding unit 3B is the target paper feeding unit 3, start timing of the secondary paper feeding is later than that in the case where the first paper feeding unit 3A is the target paper feeding unit 3.

Although not limited particularly, in the case where the second paper feeding unit 3B is the target paper feeding unit 3, the start timing of the secondary paper feeding is set to be a few milliseconds to a few tens of milliseconds later than that in the case where the first paper feeding unit 3A is the target paper feeding unit 3. For example, the preceding feeding time is set to 90 ms in the case where the first paper feeding unit 3A is the target paper feeding unit 3, and the preceding feeding time is set to a time longer than 90 ms (for example, 100 ms or more) in the case where the second paper feeding unit 3B is the target paper feeding unit 3.

Figure 6:
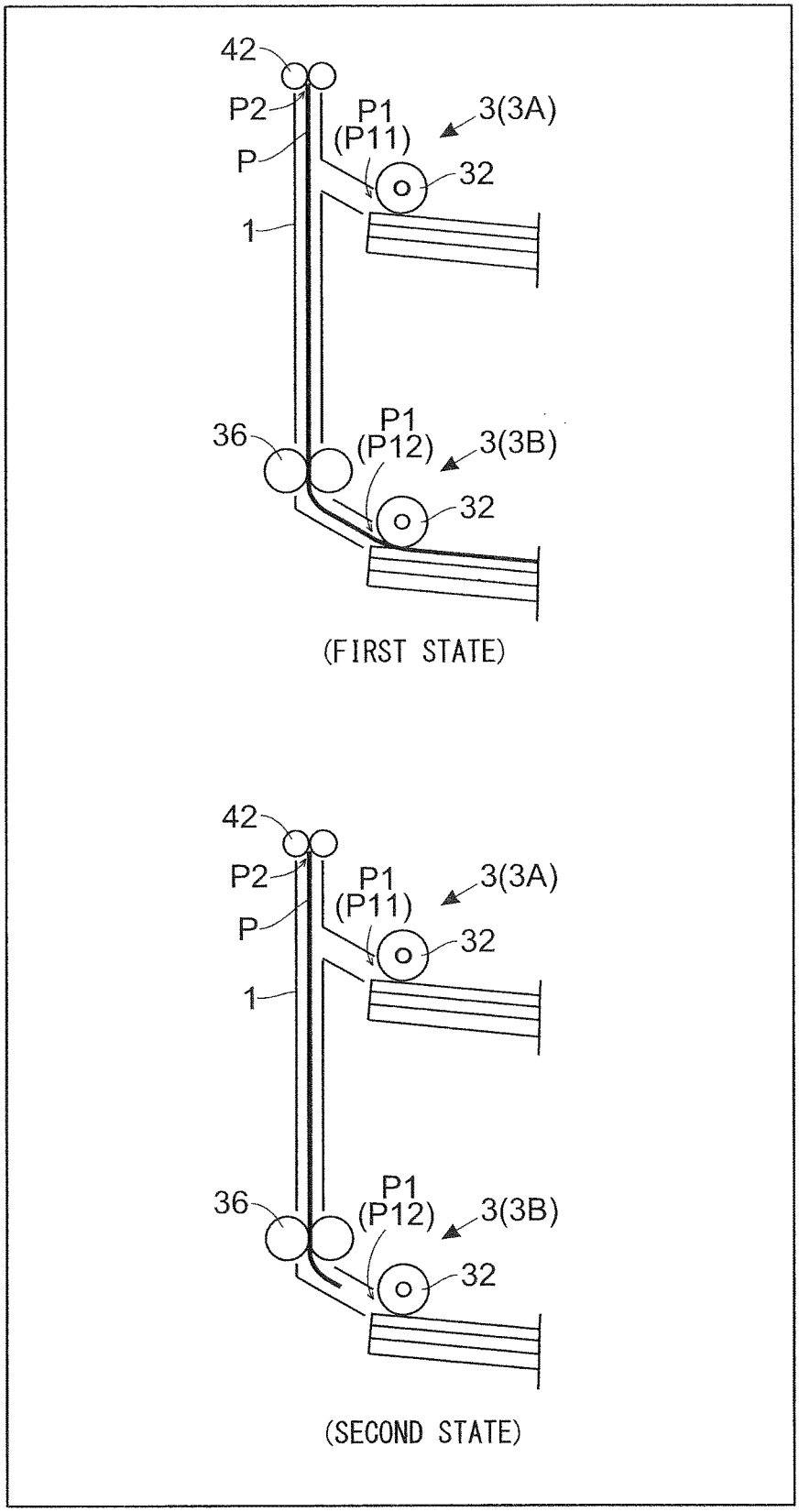
FIG. 6 is a diagram illustrating a paper sheet position at a time point when primary paper feeding is finished in the image forming apparatus according to the first embodiment of the present disclosure (a diagram illustrating a first state and a second state).

In addition, as illustrated in FIG. 6, in the case where the second paper feeding unit 3B is the target paper feeding unit 3, depending on the conveying direction length of the paper sheet P, there is a case of a first state where the rear edge of the paper sheet P has not yet passed the position of the paper feed roller 32 (the paper feeding position P12) at the time point when the primary paper feeding is finished (the time point just before the preceding paper feeding is started), or a case of a second state where the rear edge of the paper sheet P has already passed the position of the paper feed roller 32. In other words, there is a case where a part on the rear edge of the paper sheet P remains at the position of the paper feed roller 32 (the first state), or a case where the part on the rear edge of the paper sheet P does not remain at the position of the paper feed roller 32 (the second state).

For example, if the first state (see the upper part in FIG. 6) is the current state at the time point when the primary paper feeding is finished, the preceding paper feeding is performed by both the paper feed roller 32 and the intermediate roller pair 36, and hence the slip occurs more hardly when the preceding paper feeding is performed than in the case of the second state (see the lower part in FIG. 6) at the time point when the primary paper feeding is finished. In other words, if the second state is the current state at the time point when the primary paper feeding is finished, the preceding paper feeding is performed by only the intermediate roller pair 36, and hence the slip easily occurs.

Note that, because the one roller 36*a* of the intermediate roller pair 36 is attached to the open/close cover 37, nip pressure of the intermediate roller pair 36 is apt to be low. Thus, if the preceding paper feeding is performed by only the intermediate roller pair 36, the slip occurs more easily.

Therefore, when selecting the second paper feeding unit 3B as the target paper feeding unit 3, the control unit 110 sets the preceding feeding time in the case of the second state (see the lower part in FIG. 6) at the time point when the primary paper feeding is finished to be longer than the preceding feeding time in the case of the first state (see the upper part in FIG. 6) at the time point when the primary paper feeding is finished. In other words, in the case of the second state at the time point when the primary paper feeding is finished, the time for correcting a skew of the paper sheet P is set to be longer (so that the start timing of the secondary paper feeding is later) than that in the case of the first state at the time point when the primary paper feeding is finished.

Here, if the conveying direction length of the paper sheet P to be printed is longer than the conveying distance of the paper sheet P from the position of the paper feed roller 32 of the second paper feeding unit 3B (the paper feeding position P12) to the position of the registration roller pair 42 (the registration position P2), it is considered that the first state is realized at the time point when the primary paper feeding is finished. On the other hand, if the conveying direction length of the paper sheet P to be printed is shorter than the conveying distance of the paper sheet P from the position of the paper feed roller 32 of the second paper feeding unit 3B to the position of the registration roller pair 42, it is considered that the second state is realized at the time point when the primary paper feeding is finished.

Therefore, the conveying distance of the paper sheet P from the position of the paper feed roller 32 of the second paper feeding unit 3B to the position of the registration roller pair 42 is determined in advance, and the conveying distance is stored as a threshold length in the storage unit 112 in advance. Alternatively, the conveying distance plus a margin is stored as the threshold length in the storage unit 112 in advance.

Further, when selecting the second paper feeding unit 3B as the target paper feeding unit 3, the control unit 110 sets the preceding feeding time in the case where the conveying direction length of the paper sheet P to be printed is the threshold length (for example 200 mm) or less to be longer than the preceding feeding time in the case where the conveying direction length of the paper sheet P to be printed is more than the threshold length. In this way, in the case where the conveying direction length of the paper sheet P to be printed is the threshold length or less (in the case of the second state at the time point when the primary paper feeding is finished), the time for correcting a skew of the paper sheet P is set to be longer than that in the case where the conveying direction length of the paper sheet P to be printed is more than the threshold length (in the case of the first state at the time point when the primary paper feeding is finished).

For example, as illustrated in FIG. 7, if the conveying direction length of the paper sheet P to be printed is more than the threshold length, the preceding feeding time is set to 100 ms. Further, if the conveying direction length of the paper sheet P to be printed is the threshold length or less, the preceding feeding time is set to 110 ms.

Here, the rollers for conveying the paper sheet P are deteriorated with time. In other words, as rotation time (operation time) of the roller is longer, the roller is deteriorated more. As the deterioration of the roller becomes larger, the roller is more apt to slip on the paper sheet P. Therefore, it is preferred to control so that the preceding feeding time is longer as an accumulated value of the operation time of the target paper feeding unit 3 is larger.

In order to perform this control, the storage unit 112 stores operation time information indicating the accumulated values of the operation time of the first paper feeding unit 3A and the second paper feeding unit 3B. For example, the storage unit 112 stores information indicating the accumulated value of the rotation time of the paper feed roller 32 of the first paper feeding unit 3A as the operation time information corresponding to the first paper feeding unit 3A. In addition, the storage unit 112 stores information indicating the accumulated value of the rotation time of the intermediate roller pair 36 of the second paper feeding unit 3B as the operation time information corresponding to the second paper feeding unit 3B (information indicating the accumulated value of the rotation time of the paper feed roller 32 of the second paper feeding unit 3B may be stored as the operation time information corresponding to the second paper feeding unit 3B).

Further, the control unit 110 determines the accumulated value of the operation time of the target paper feeding unit 3 based on the operation time information and sets the preceding feeding time to a longer value as the determined accumulated value is larger. For example, the control unit 110 sets the preceding feeding time in the case where the accumulated value of the operation time of the target paper feeding unit 3 is longer than a predetermined threshold time (for example 10,000 minutes) to be longer than the preceding feeding time in the case where the accumulated value of the operation time of the target paper feeding unit 3 is the threshold time or less.

As an example, as illustrated in FIG. 8, in the case where the first paper feeding unit 3A is the target paper feeding unit 3, the preceding feeding time is set to 90 ms if the accumulated value of the operation time of the first paper feeding unit 3A is the threshold time (10,000 minutes) or less, and the preceding feeding time is set to 100 ms if the accumulated value of the operation time of the first paper feeding unit 3A is longer than the threshold time.

In the case where the second paper feeding unit 3B is the target paper feeding unit 3, the preceding feeding time is set in consideration of not only the accumulated value of the operation time of the second paper feeding unit 3B but also the conveying direction length of the paper sheet P to be printed. In other words, if the accumulated value of the operation time of the second paper feeding unit 3B is the threshold time (10,000 minutes) or less, and if the conveying direction length of the paper sheet P to be printed is the threshold length (200 mm) or less, the preceding feeding time is set to 110 ms, and if the conveying direction length of the paper sheet P to be printed is longer than the threshold length, the preceding feeding time is set to 100 ms. In addition, if the accumulated value of the operation time of the second paper feeding unit 3B is longer than the threshold time, and if the conveying direction length of the paper sheet P to be printed is the threshold length or less, the preceding feeding time is set to 120 ms, and if the conveying direction length of the paper sheet P to be printed is longer than the threshold length, the preceding feeding time is set to 110 ms.

Note that number-of-fed-sheet information indicating the accumulated value of the number of fed paper sheets of each of the first paper feeding unit 3A and the second paper feeding unit 3B may be stored in the storage unit 112, and the preceding feeding time may be set based on the number-of-fed-sheet information. In this case, as the accumulated number of fed paper sheets of the target paper feeding unit 3 is larger, the control unit 110 determines that the accumulated value of the operation time of the target paper feeding unit 3 is larger. In other words, as the accumulated number of fed paper sheets of the target paper feeding unit 3 is larger, the control unit 110 sets the preceding feeding time to be longer.

Figure 9:
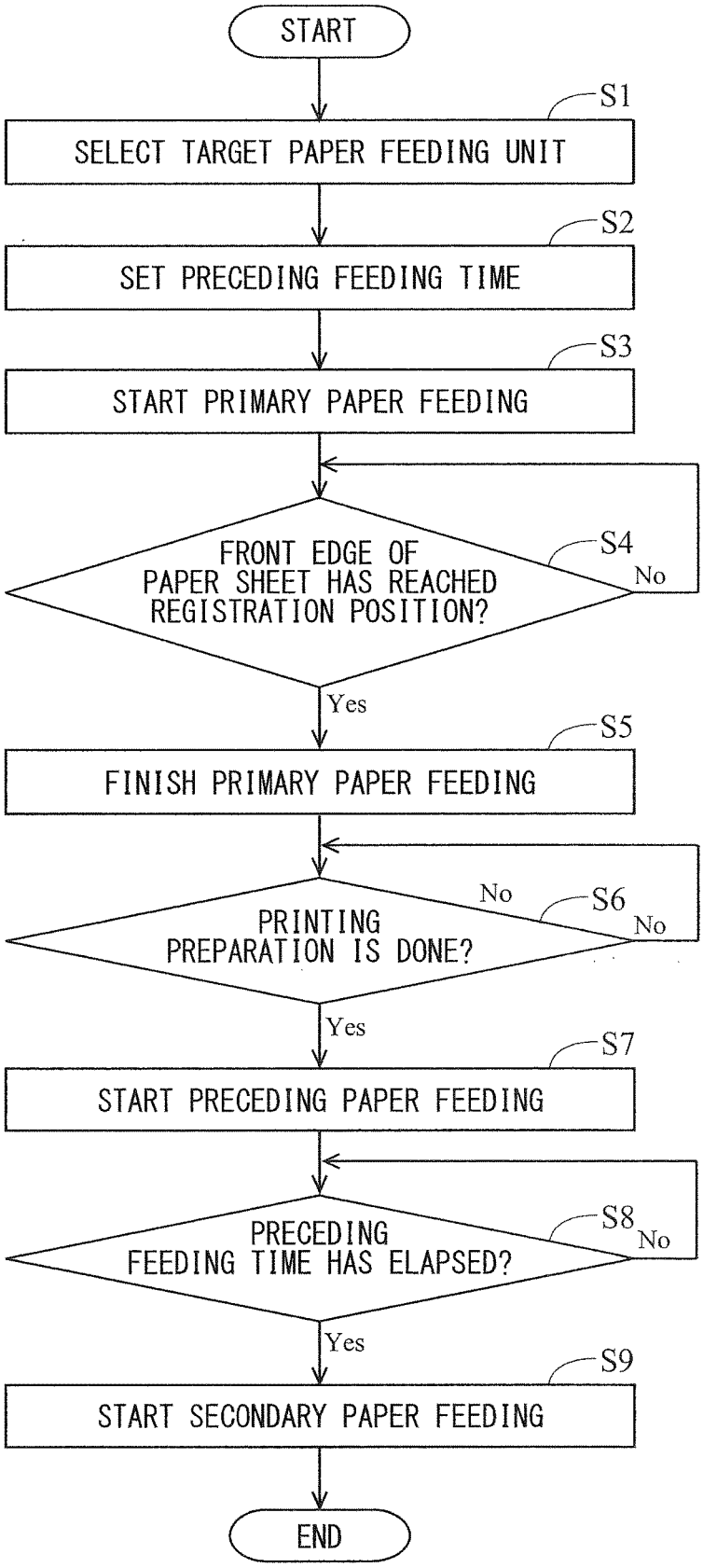
FIG. 9 is a flowchart for explaining the paper conveying operation of the image forming apparatus according to the first embodiment of the present disclosure.

Hereinafter, with reference to the flowchart illustrated in FIG. 9, a process flow of the paper feeding operation is described. The flowchart illustrated in FIG. 9 starts when the instruction to execute a print job is received.

In Step S1, the control unit 110 recognizes the designated cassette 31. In this case, the control unit 110 selects the paper feeding unit for feeding the paper sheet P in the designated cassette 31 to the paper conveying path 1 so as to convey the same, from the first paper feeding unit 3A and the second paper feeding unit 3B, as the target paper feeding unit 3. Further, in Step S2, the control unit 110 sets the preceding feeding time. After that, in Step S3, the control unit 110 starts the primary paper feeding.

Next, in Step S4, the control unit 110 determines whether or not the front edge of the paper sheet P has reached the registration position P2. As a result, if the control unit 110 determines that the front edge of the paper sheet P has reached the registration position P2, the process proceeds to Step S5. If the control unit 110 determines that the front edge of the paper sheet P has not reached the registration position P2, the determination process of Step S4 is repeated.

When proceeding to Step S5, the control unit 110 finishes the primary paper feeding. After that, in Step S6, the control unit 110 determines whether or not the printing preparation is done. As a result, if the control unit 110 determines that the printing preparation is done, the process proceeds to Step S7. If the control unit 110 determines that the preparation is not done, the determination process of Step S6 is repeated.

When proceeding to Step S7, the control unit 110 starts the preceding paper feeding. After that, in Step S8, the control unit 110 determines whether or not the preceding feeding time (set in Step S2) has elapsed from the start of the preceding paper feeding. As a result, if the control unit 110 determines that the preceding feeding time has elapsed, the process proceeds to Step S9. If the control unit 110 determines that the preceding feeding time has not elapsed, the determination process of Step S8 is repeated. Further, when proceeding to Step S9, the control unit 110 starts the secondary paper feeding.

As described above, the image forming apparatus 100 (101) of the first embodiment includes the paper conveying path 1 for conveying the paper sheet P to the printing position P3 via the registration position P2, the registration roller pair 42 (registration unit) that operates to convey the paper sheet P after reaching the registration position P2 to the printing position P3, the first paper feeding unit 3A that operates to convey the paper sheet P to the registration position P2, the second paper feeding unit 3B that operates to convey the paper sheet P to the registration position P2, and the control unit 110, which selects the paper feeding unit for conveying the paper sheet P to be printed as the target paper feeding unit 3 from the first paper feeding unit 3A and the second paper feeding unit 3B, sets the preceding feeding time, performs the primary paper feeding in which the registration roller pair 42 is not operated but the target paper feeding unit 3 is operated so as to convey the paper sheet P to the registration position P2, finishes the primary paper feeding at the timing when the paper sheet P reaches the registration position P2, and then performs the secondary paper feeding in which the registration roller pair 42 is not operated but the target paper feeding unit 3 is operated until the preceding feeding time elapses, and afterward the registration roller pair 42 is operated while continuing to operate the target paper feeding unit 3 so that the paper sheet P after reaching the registration position P2 is conveyed to the printing position P3. Further, the control unit 110 sets different values of the preceding feeding time for the case where the first paper feeding unit 3A is the target paper feeding unit 3 and the case where the second paper feeding unit 3B is the target paper feeding unit 3.

In the first embodiment, after the primary paper feeding, before the secondary paper feeding, the registration roller pair 42 is not operated, but the target paper feeding unit 3 is operated until the preceding feeding time elapses (the preceding paper feeding is performed), and hence a skew of the paper sheet P can be corrected. Here, the control unit 110 sets different values of the preceding feeding time for the case where the first paper feeding unit 3A is the target paper feeding unit 3 and the case where the second paper feeding unit 3B is the target paper feeding unit 3. Specifically, the preceding feeding time in the case where the second paper feeding unit 3B (that slips more easily on the paper sheet P when the preceding paper feeding is performed) is the target paper feeding unit 3 is set to be longer than the preceding feeding time in the case where the first paper feeding unit 3A is the target paper feeding unit 3. In this way, even if the second paper feeding unit 3B, which easily slips on the paper sheet P when the preceding paper feeding is performed, is the target paper feeding unit 3, it is possible to prevent occurrence of inconvenience that the large slip on the paper sheet P causes insufficient skew correction of the paper sheet P (insufficient pressing of the front edge of the paper sheet P to the registration roller pair 42). In other words, it is possible to suppress positional deviation of an image printed on the paper sheet P (to prevent the paper sheet P from being conveyed in a skewed state to the printing position P3).

In addition, in the first embodiment, as described above, the storage unit 112 stores the accumulated values of the operation time of the first paper feeding unit 3A and the second paper feeding unit 3B. Further, the control unit 110 determines the accumulated value corresponding to the target paper feeding unit 3 and sets the preceding feeding time to a larger value as the determined accumulated value is larger. In this structure, because the preceding feeding time becomes longer as the accumulated value of the operation time of the target paper feeding unit 3 is larger, it is possible to prevent the skew correction of the paper sheet P from being insufficient even if the target paper feeding unit 3 is apt to slip on the paper sheet P due to temporal deterioration of the target paper feeding unit 3 (wearing deterioration or the like of the paper feed roller 32 or the intermediate roller pair 36).

In addition, in the first embodiment, as described above, the storage unit 112 stores the conveying distance of the paper sheet P from the paper feed roller 32 of the second paper feeding unit 3B to the registration roller pair 42 or the conveying distance plus a margin, as a threshold length. Then, in the case where the second paper feeding unit 3B is the target paper feeding unit 3, the control unit 110 sets the preceding feeding time in the case where the conveying direction length of the paper sheet P to be printed is the threshold length or less to be longer than the preceding feeding time in the case where the conveying direction length of the paper sheet P to be printed is longer than the threshold length. In this structure, because the preceding feeding time in the case of the second state at the start time point of the preceding paper feeding (see the lower part in FIG. 6) is longer than the preceding feeding time in the case of the first state (see the upper part in FIG. 6), it is possible to prevent insufficient skew correction of the paper sheet P regardless of the conveying direction length of the paper sheet P.

Note that, depending on mounting structures (mounting positions and the like) of the paper feed roller 32 and the intermediate roller pair 36, a shape of the paper conveying path 1 from the paper feed roller 32 to the registration roller pair 42, or the like, the slip when the first paper feeding unit 3A performs the preceding paper feeding may be larger than the slip when the second paper feeding unit 3B performs the preceding paper feeding. In this case, the preceding feeding time in the case where the first paper feeding unit 3A is the target paper feeding unit 3 may be set to be longer than the preceding feeding time in the case where the second paper feeding unit 3B is the target paper feeding unit 3.

Second Embodiment

<Structure of Image Forming Apparatus>

Figure 10:
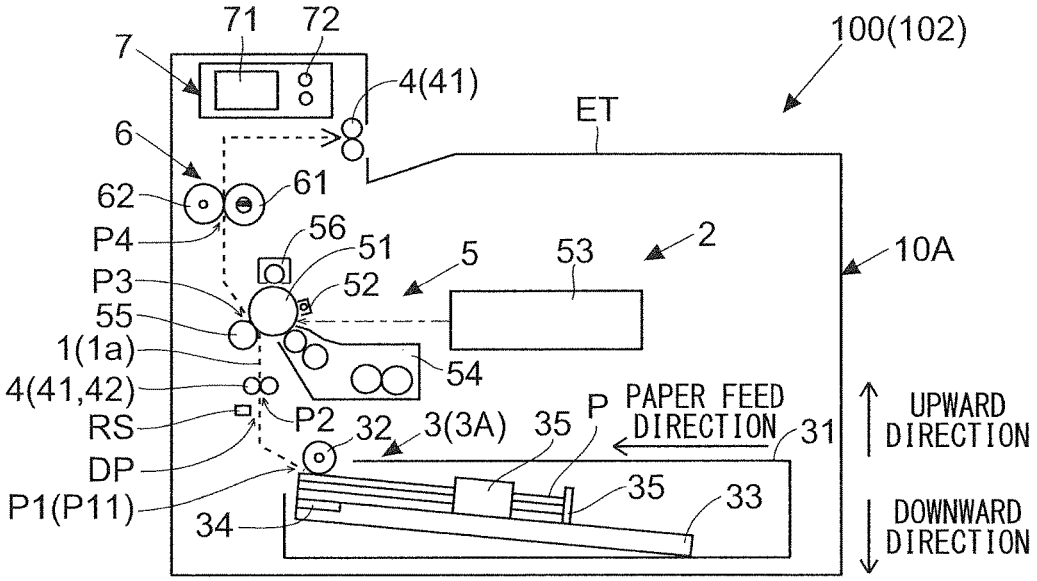
FIG. 10 is a diagram illustrating an overall structure of an image forming apparatus according to a second embodiment of the present disclosure.
Figure 11:
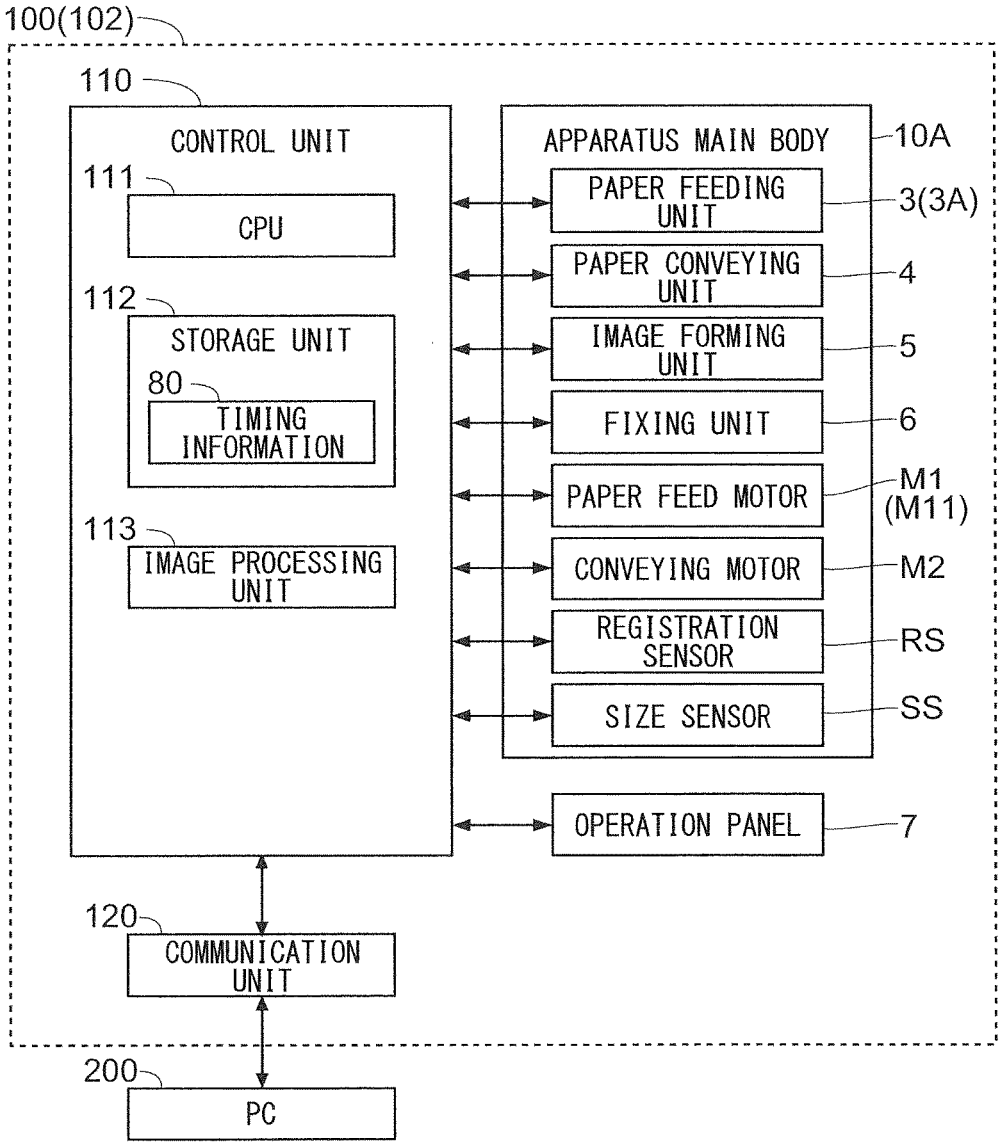
FIG. 11 is a diagram illustrating a hardware structure of the image forming apparatus according to the second embodiment of the present disclosure.

As illustrated in FIGS. 10 and 11, the image forming apparatus 100 (102) of a second embodiment is different from that of the first embodiment in that the optional sheet feeding device 10B is removed from the apparatus main body 10A. In other words, the paper conveying path 1 of the image forming apparatus 102 includes only the paper conveying path 1*a*. In addition, the paper feeding unit 3 of the image forming apparatus 102 includes only the first paper feeding unit 3A. Other structures of the second embodiment are the same as those of the first embodiment.

<Primary Paper Feeding and Secondary Paper Feeding>

When the control unit 110 receives the instruction to execute a print job (When the communication unit 120 receives the job data), the control unit 110 performs the image processing (such as conversion into the image data for exposure) on the image data. In addition, the control unit 110 performs the primary paper feeding. After that, the control unit 110 performs the secondary paper feeding. Hereinafter, with reference to the timing chart illustrated in FIG. 12, the primary paper feeding and the secondary paper feeding are described.

First, the primary paper feeding is described. When receiving the instruction to execute a print job (time point TP21), the control unit 110 starts the primary paper feeding. In this case, the control unit 110 drives the paper feed motor M1 to rotate the paper feed roller 32. In addition, the control unit 110 drives the conveying motor M2 to rotate the plurality of conveying roller pairs 41. However, the control unit 110 turns off the registration clutch. In other words, the control unit 110 does not drive the registration roller pair 42 to rotate but drives only the other conveying roller pair 41 to rotate.

When the paper feed roller 32 rotates, the paper sheet P is fed to the paper conveying path 1, and the paper sheet P is conveyed along the paper conveying path 1. Then, the front edge of the paper sheet P reaches the detection position DP (time point TP22). In this way, the output value of the registration sensor RS changes from L level indicating absence of the paper sheet P to H level indicating presence of the paper sheet P. In other words, the control unit 110 detects that the front edge of the paper sheet P has reached the detection position DP.

Next, after detecting that the front edge of the paper sheet P has reached the detection position DP, when a predetermined deflection forming time elapses (time point TP23), the control unit 110 turns off the paper feed clutch so that the rotation of the paper feed roller 32 is stopped, and thus the primary paper feeding is finished. Here, the deflection forming time is the sum of the time necessary for the paper sheet P to travel the distance between the detection position DP and the registration position P2 and a predetermined time. In other words, when the predetermined time elapses after the front edge of the paper sheet P reaches the registration position P2, the primary paper feeding is finished.

Next, the secondary paper feeding is described. After finishing the primary paper feeding, the control unit 110 determines whether or not the printing preparation is done for printing an image on the paper sheet P. For example, the control unit 110 determines that the printing preparation is done if the image processing on the image data of the image to be printed on the paper sheet P is completed so that the exposing device 53 is ready to perform exposure of the photosensitive drum 51 (formation of an electrostatic latent image).

When the printing preparation is done (time point TP24), the control unit 110 starts the secondary paper feeding. In this case, the control unit 110 turns on the paper feed clutch so that the paper feed roller 32 rotates. In addition, the control unit 110 turns on the registration clutch so that the registration roller pair 42 rotates.

In this way, a part of the paper sheet P whose front edge has reached the registration position P2, which remains at the paper feeding position P1, is sent out by the paper feed roller 32 in the paper feed direction, and the front edge of the paper sheet P enters the nip of the registration roller pair 42. Then, the paper sheet P that has entered the nip of the registration roller pair 42 is conveyed to the printing position P3 by the registration roller pair 42 (the secondary paper feeding is performed). After starting the secondary paper feeding, the control unit 110 starts the exposure of the photosensitive drum 51 by the exposing device 53 (the formation of the electrostatic latent image).

<Start Timing of Secondary Paper Feeding>

Figure 13:
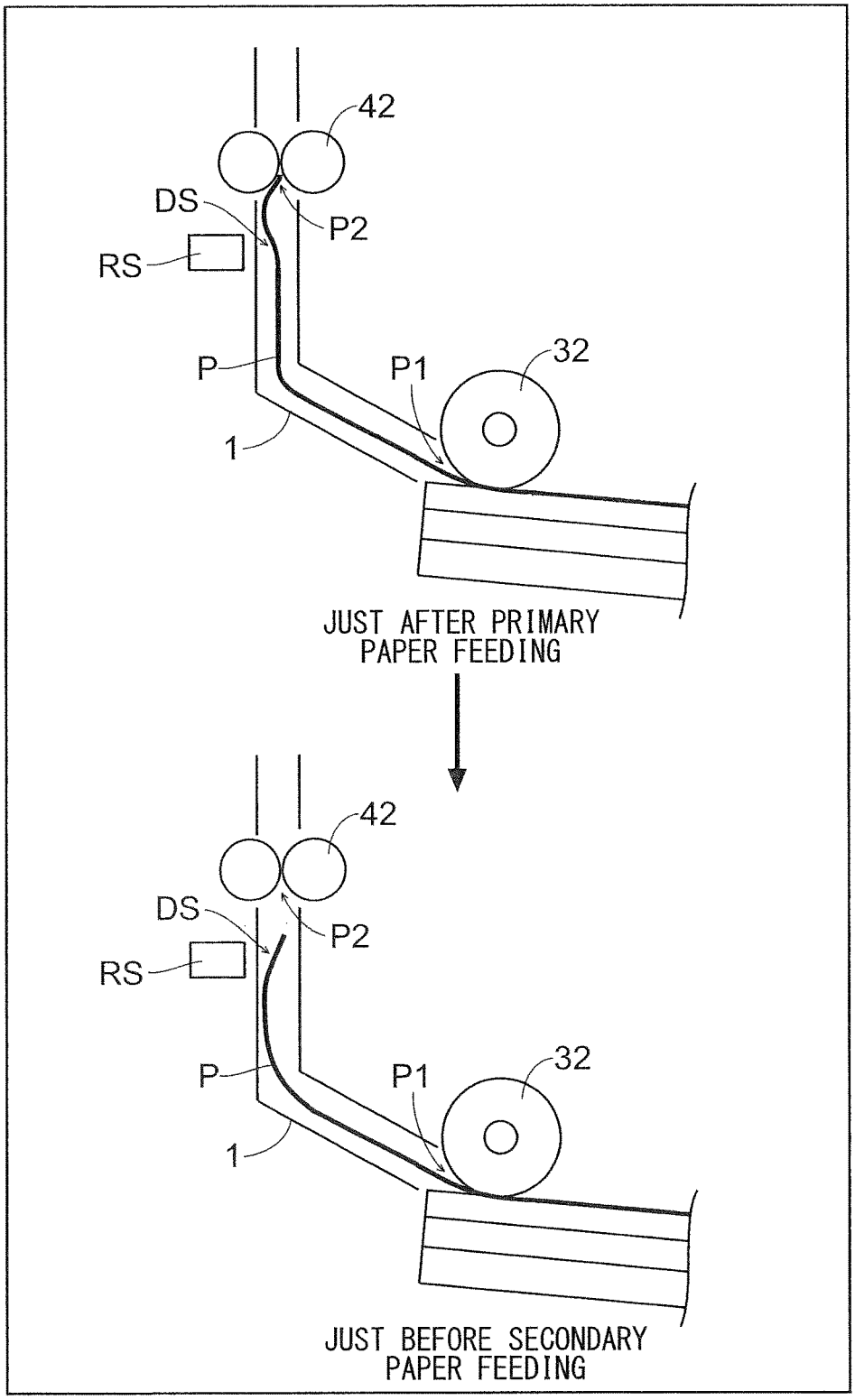
FIG. 13 is a diagram for explaining a backslide of the front edge of the paper sheet that occurs at a registration position in the image forming apparatus according to the second embodiment of the present disclosure.

In the second embodiment, there is no rollers (roller pair) for conveying the paper sheet P on the conveying path of the paper sheet P between the paper feeding position P1 and the registration position P2. Therefore, if time after the primary paper feeding is finished until the printing preparation is done becomes long (if a period of time after the primary paper feeding is finished until the secondary paper feeding starts becomes long), the front edge part of the paper sheet P that has reached the registration position P2 causes backslide due to its weight as illustrated in FIG. 13. In other words, the front edge of the paper sheet P moves downward from the registration position P2 (the front edge part of the paper sheet P sags down). If the secondary paper feeding starts in the state where the front edge of the paper sheet P is below the registration position P2, there occurs an inconvenience that the timing when the front edge of the paper sheet P reaches the printing position P3 is delayed from the target timing (the timing when the secondary paper feeding is started in the state where the front edge of the paper sheet P is at the registration position P2).

Therefore, when the primary paper feeding is finished, the control unit 110 measures waiting time after the primary paper feeding is finished until the printing preparation is done, and determines whether or not the measured time as the waiting time (hereinafter may be simply referred to as the measured time) is longer than a predetermined threshold time (for example 50 ms). For example, time after the front edge of the paper sheet P reaches the registration position P2 until the front edge part of the paper sheet P starts to backslide is determined in an experimental manner or a simulating manner in advance, and the determined time is set as the threshold time.

Figure 12:
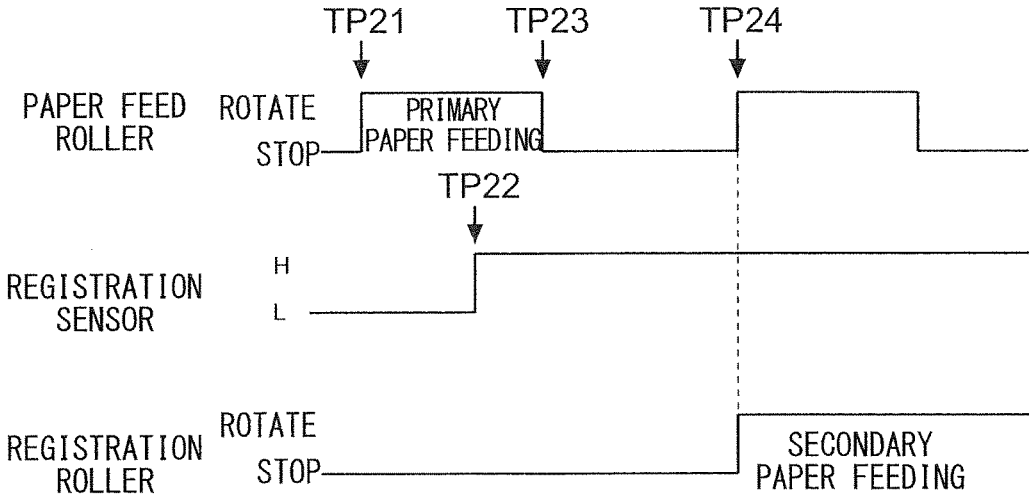
FIG. 12 is a timing chart for explaining a paper conveying operation of the image forming apparatus according to the second embodiment of the present disclosure.

Further, when the printing preparation is done, if the measured time is the threshold time or less, the control unit 110 starts the secondary paper feeding at once. In other words, when the printing preparation is done, the control unit 110 starts to rotate the paper feed roller 32 and the registration roller pair 42 at the same time. Therefore, when the printing preparation is done, the paper sheet P is conveyed from the registration position P2 to the printing position P3. Note that, in this case, the secondary paper feeding is started at the same timing as shown in FIG. 12.

Figures 14, 15:
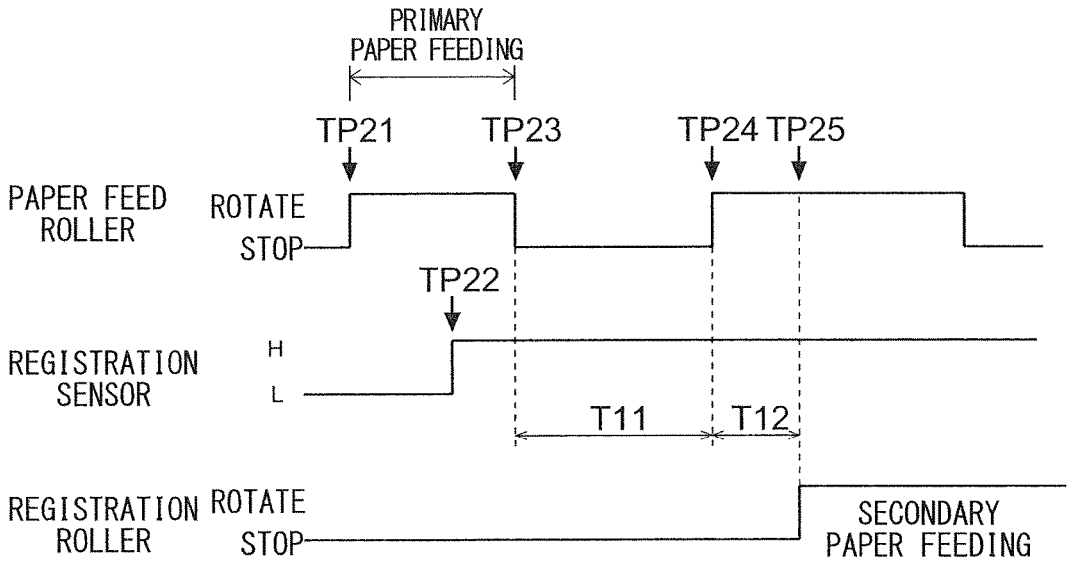
FIG. 14 is a timing chart for explaining the paper conveying operation of the image forming apparatus according to the second embodiment of the present disclosure.
FIG. 15 is a table showing timing information stored in a storage unit of the image forming apparatus according to the second embodiment of the present disclosure.

On the other hand, when the printing preparation is done, if the measured time is longer than the threshold time (if the front edge of the paper sheet P is below the registration position P2), the secondary paper feeding is started at timing as shown in FIG. 14. In the timing chart illustrated in FIG. 14, it is supposed that waiting time T11 after the primary paper feeding is finished until the printing preparation is done is the threshold time or longer.

Specifically, when the printing preparation is done (time point TP24), the control unit 110 does not start the rotation of the registration roller pair 42 but starts the rotation of the paper feed roller 32 first. In this way, even if the front edge of the paper sheet P is below the registration position P2, the front edge of the paper sheet P returns to the registration position P2. After that, when time T12 elapses (time point TP25) after the rotation of the paper feed roller 32 is started, the control unit 110 starts the rotation of the registration roller pair 42 while continuing the rotation of the paper feed roller 32 (the secondary paper feeding is started).

Here, as the waiting time after the primary paper feeding is finished until the printing preparation is done is longer, backslide amount of the paper sheet P when the printing preparation is done becomes larger. Therefore, it is preferred to set a longer time for returning the front edge of the paper sheet P to the registration position P2 as the waiting time is longer.

Therefore, the time from the rotation start of the paper feed roller 32 to the rotation start of the registration roller pair 42 (denoted by T12 in FIG. 14) is changed in accordance with the waiting time (denoted by T11 in FIG. 14). For example, the storage unit 112 stores timing information 80 for measuring rotation start timing of the registration roller pair 42 (see FIG. 11). In this timing information 80, the waiting time is classified into a plurality of time ranges, and time differences respectively corresponding to the plurality of time ranges are determined in advance, so that the time difference between the rotation start timing (operation start timing) of the paper feed roller 32 and the rotation start timing (operation start timing) of the registration roller pair 42 becomes larger as the waiting time is longer.

As an example, as illustrated in FIG. 15, the time difference in the case where the waiting time is 51 ms or more to 100 ms or less is set to 45 ms, and the time difference in the case where the waiting time is 101 ms or more is set to 90 ms. Note that the time difference in the case where the waiting time is 50 ms or less (namely in the case where the waiting time is the threshold time or less) is 0 ms.

Further, if the measured time as the waiting time is longer than the threshold time, the control unit 110 determines the time difference corresponding to the measured time based on the timing information 80, and delays the rotation start timing of the registration roller pair 42 from the rotation start timing of the paper feed roller 32 by the determined time difference. In other words, if the measured time as the waiting time is longer than the threshold time, the rotation start timing of the registration roller pair 42 is delayed longer from the rotation start timing of the paper feed roller 32 (the period of time between the rotation start timing of the paper feed roller 32 and the rotation start timing of the registration roller pair 42 becomes longer) as the measured time is longer. As a result, as the measured time as the waiting time is longer, a longer time is set for returning the front edge of the paper sheet P to the registration position P2. With reference to the timing chart illustrated in FIG. 14, the time T12 becomes longer so that the rotation start timing of the registration roller pair 42 is delayed longer as the waiting time T11 is longer.

Figure 16:
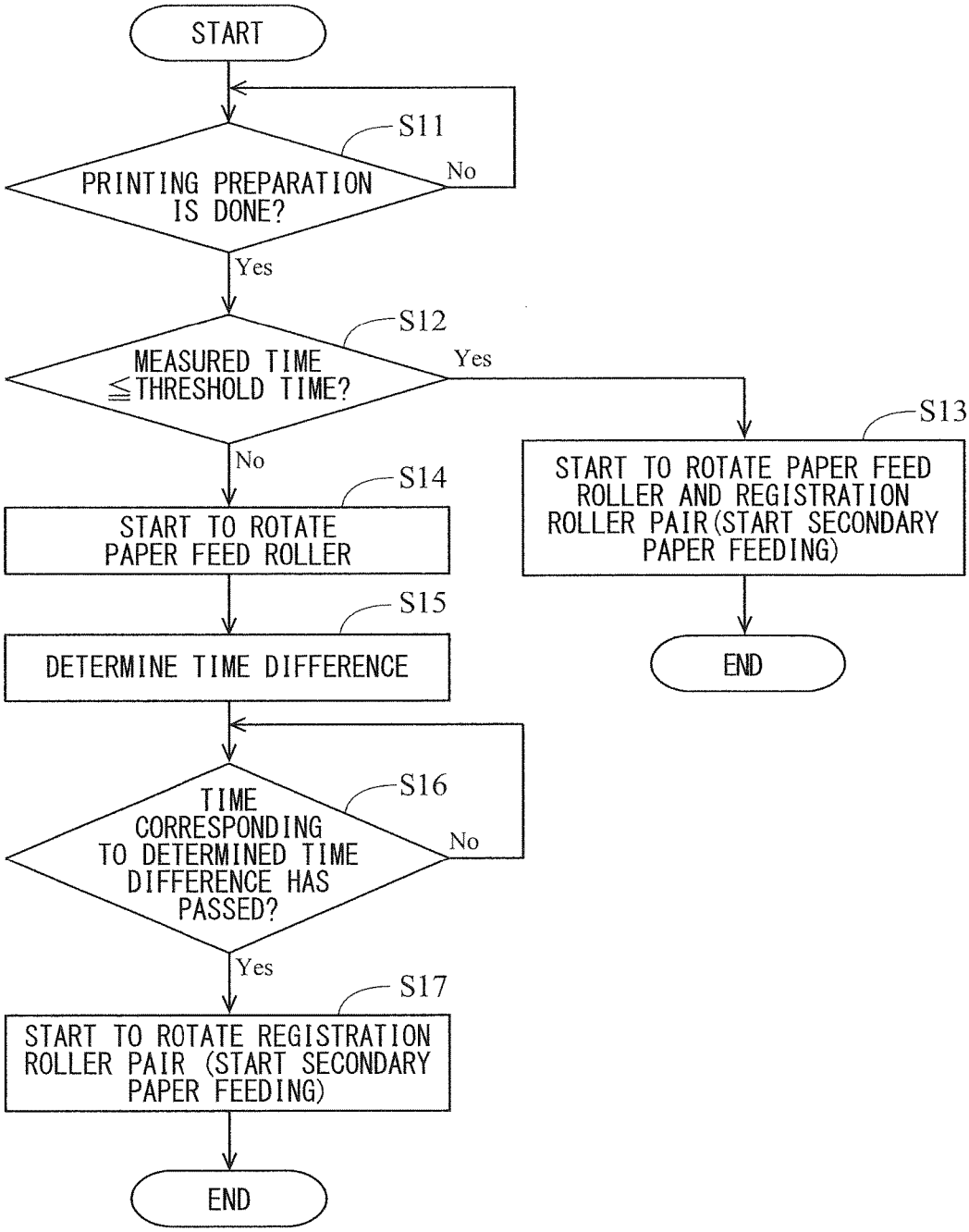
FIG. 16 is a flowchart for explaining the paper conveying operation of the image forming apparatus according to the second embodiment of the present disclosure.

Hereinafter, with reference to the flowchart illustrated in FIG. 16, the process flow after the primary paper feeding is finished is described. The flowchart illustrated in FIG. 16 starts when the primary paper feeding is finished. Note that, when the primary paper feeding is finished, the control unit 110 starts to measure the waiting time.

In Step S11, the control unit 110 determines whether or not the printing preparation is done. As a result, if the control unit 110 determines that the printing preparation is done, the process proceeds to Step S12. If the control unit 110 determines that the printing preparation is not done, the determination process of Step S11 is repeated.

When proceeding to Step S12, the control unit 110 determines whether or not the measured time as the waiting time is the threshold time or shorter. As a result, if the control unit 110 determines that the measured time (waiting time) is the threshold time or shorter, the process proceeds to Step S13. If the control unit 110 determines that the measured time (waiting time) is longer than the threshold time, the process proceeds to Step S14.

When proceeding to Step S13, the control unit 110 starts to rotate the paper feed roller 32 and the registration roller pair 42 at the same time. In this case, the secondary paper feeding is started at the time point when the printing preparation is done.

When proceeding to Step S14, the control unit 110 does not start the rotation of the registration roller pair 42 but starts the rotation of the paper feed roller 32. In other words, the secondary paper feeding is not started at the time point when the printing preparation is done. In this case, if the backslide of the front edge part of the paper sheet P has occurred at the registration position P2, the front edge of the paper sheet P is returned to the registration position P2.

Next, in Step S15, the control unit 110 determines the time difference corresponding to the measured time based on the timing information 80. After that, in Step S16, the control unit 110 determines whether or not the time corresponding to the time difference determined in Step S5 has elapsed after the rotation of the paper feed roller 32 is started. As a result, if the control unit 110 determines that the time corresponding to the time difference has elapsed, the process proceeds to Step S17. If the control unit 110 determines that the time corresponding to the time difference has not elapsed, the determination process of Step S16 is repeated.

When proceeding to Step S17, the control unit 110 starts the rotation of the registration roller pair 42. In this case, the control unit 110 continues the rotation of the paper feed roller 32. In this way, the secondary paper feeding is started in which both the paper feed roller 32 and the registration roller pair 42 are rotated.

As described above, the image forming apparatus 100 (102) of the second embodiment includes a paper conveying path 1 for conveying the paper sheet P from the paper feeding position P1 to the printing position P3 via the registration position P2 positioned above the paper feeding position P1, the paper feeding unit 3 for feeding the paper sheet P from the paper feeding position P1 to the registration position P2 by upward movement of the lift plate 34 and rotation of the paper feed roller 32, the registration roller pair 42 (registration unit) that rotates to convey the paper sheet P after reaching the registration position P2 to the printing position P3, the image forming unit 5 that forms an image to be printed on the paper sheet P and prints the image on the paper sheet P conveyed to the printing position P3, and the control unit 110 that performs the primary paper feeding in which the registration roller pair 42 is not rotated but the paper feed roller 32 is rotated so that the paper sheet P is conveyed from the paper feeding position P1 to the registration position P2, finishes the primary paper feeding at a predetermined time after the paper sheet P reaches the registration position P2, and then after the printing preparation for printing the image on the paper sheet P is done, performs the secondary paper feeding in which the paper feed roller 32 and the registration roller pair 42 are rotated so that the paper sheet P after reaching the registration position P2 is conveyed to the printing position P3. The control unit 110 measures the waiting time after the primary paper feeding is finished until the printing preparation is done. When the printing preparation is done, if the measured time as the waiting time is longer than the predetermined threshold time, the rotation of the paper feed roller 32 is started first, and then the rotation of the registration roller pair 42 is started while continuing the rotation of the paper feed roller 32, so that the secondary paper feeding is started. If the measured time is the threshold time or shorter, both the paper feed roller 32 and the registration roller pair 42 are started to rotate at the same time, so that the secondary paper feeding is started.

In the second embodiment, when the printing preparation is done, the rotation of the paper feed roller 32 is started first, and hence even if the front edge of the paper sheet P is moved to a position below the registration position P2, the front edge of the paper sheet P returns to the registration position P2. Therefore, the secondary paper feeding can be started in the state where the front edge of the paper sheet P is returned to the registration position P2. In this way, it is possible to prevent the timing when the front edge of the paper sheet P reaches the printing position P3 after the secondary paper feeding is started from being later than the target timing (the timing when the secondary paper feeding is started in the state where the front edge of the paper sheet P is at the registration position P2). In other words, it is possible to suppress positional deviation of an image printed on the paper sheet P. Therefore, in order to suppress positional deviation of an image printed on the paper sheet P, it is not necessary to change the shape of the paper conveying path 1 or to dispose an additional roller and sensor (it is possible to suppress an increase in size of the apparatus or in the number of components).

Here, if the waiting time after the primary paper feeding is finished until the printing preparation is done is long, the backslide of the paper sheet P is apt to occur. On the other hand, if the waiting time is short, the backslide of the paper sheet P hardly occurs (or the backslide of the paper sheet P does not occur). In this case, the process of staring the rotation of the paper feed roller 32 first is not necessary.

Therefore, in the first embodiment, as described above, when the printing preparation is done, if the measured time as the waiting time is longer than the threshold time (if the backslide of the paper sheet P has occurred), the process of staring the rotation of the paper feed roller 32 first is performed. On the other hand, if the measured time is the threshold time or shorter (if the backslide of the paper sheet P has not occurred), the process of staring the rotation of the paper feed roller 32 first is not performed. In other words, the secondary paper feeding is started at once when the printing preparation is done. In this way, it is possible to suppress execution of the process of staring the rotation of the paper feed roller 32 first (unnecessary process) when the backslide of the paper sheet P has not occurred.

In addition, in the first embodiment, as described above, the storage unit 112 stores the timing information 80, in which the waiting time is classified into a plurality of time ranges, and time differences between the rotation start timing of the paper feed roller 32 and the rotation start timing of the registration roller pair 42, which respectively correspond to the plurality of time ranges, are determined in advance, so that the time difference is larger as the waiting time is longer. Further, when the printing preparation is done, if the measured time as the waiting time is longer than the threshold time, the control unit 110 determines the time difference corresponding to the measured time based on the timing information 80, and delays the rotation start timing of the registration roller pair 42 from the rotation start timing of the paper feed roller 32 by time corresponding to the determined time difference. In other words, when the printing preparation is done, if the measured time as the waiting time is longer than the threshold time, the control unit 110 delays the rotation start timing of the registration roller pair 42 from the rotation start timing of the paper feed roller 32 more as the measured time is longer. In this structure, as the measured time as the waiting time measured by the control unit 110 is longer (as the backslide amount of the paper sheet P when the printing preparation is done is larger), the time for returning the front edge of the paper sheet P to the registration position P2 is set to be longer. Therefore, even if the backslide amount of the paper sheet P when the printing preparation is done is large, the front edge of the paper sheet P can be returned to the registration position P2.

The embodiments described above are merely examples in every aspect and should not be interpreted as limitations. The scope of the present disclosure is defined not by the above description of the embodiments but by the claims and should be understood to include all modifications within the meaning and scope equivalent to the claims.

What is claimed is:

1. An image forming apparatus comprising:

a paper conveying path for conveying a paper sheet to a printing position via a registration position;

a registration unit configured to operate to convey the paper sheet after reaching the registration position to the printing position;

a first paper feeding unit configured to operate to convey the paper sheet to the registration position;

a second paper feeding unit configured to operate to convey the paper sheet to the registration position; and a control unit configured to select one of the first paper feeding unit and the second paper feeding unit as a target paper feeding unit for conveying the paper sheet to be printed, to set a preceding feeding time, to perform a primary paper feeding in which the registration unit is not operated but the target paper feeding unit is operated so that the paper sheet is conveyed to the registration position, to finish the primary paper feeding at timing when the paper sheet reaches the registration position, and then after operating the target paper feeding unit without operating the registration unit until the preceding feeding time elapses, to perform a secondary paper feeding in which the registration unit is operated so that the paper sheet after reaching the registration position is conveyed to the printing position, wherein the control unit sets different values of the preceding feeding time for the case where the first paper feeding unit is the target paper feeding unit and the case where the second paper feeding unit is the target paper feeding unit, the second paper feeding unit is disposed below the first paper feeding unit and includes an upstream side roller unit and a downstream side roller unit disposed on a downstream side of the upstream side roller unit in a conveying direction of the paper sheet, a storage unit is provided for storing a conveying distance of the paper sheet from the upstream side roller unit to the registration unit or the sum of the conveying distance and a margin as a threshold length, and the control unit sets the preceding feeding time in the case where the conveying direction length of the paper sheet to be printed is the threshold length or less to be longer than the preceding feeding time in the case where the conveying direction length of the paper sheet to be printed is longer than the threshold length, in the case where the second paper feeding unit is the target paper feeding unit.

2. The image forming apparatus according to claim 1, wherein the second paper feeding unit is disposed below the first paper feeding unit, and the control unit sets the preceding feeding time in the case where the second paper feeding unit is the target paper feeding unit to be longer than the preceding feeding time in the case where the first paper feeding unit is the target paper feeding unit.

3. The image forming apparatus according to claim 1, further comprising a storage unit for storing accumulated values of the operation time of the first paper feeding unit and the second paper feeding unit, wherein the control unit determines the accumulated value corresponding to the target paper feeding unit and sets the preceding feeding time to be longer as the determined accumulated value is larger.

4. The image forming apparatus according to claim 1, wherein the downstream side roller unit is a roller pair in which a pair of rollers are pressed to contact with each other, one roller of the roller pair is attached to an open/close cover that is opened to expose a part of the paper conveying path, and the one roller is separated from the other roller of the roller pair when the open/close cover is opened, and the one roller is pressed to contact with the other roller when the open/close cover is closed.

5. An image forming apparatus comprising:

a paper conveying path for conveying a paper sheet from a paper feeding position to a printing position via a registration position placed above the paper feeding position;

a paper feeding unit configured to operate to convey the paper sheet from the paper feeding position to the registration position;

a registration unit configured to operate to convey the paper sheet after reaching the registration position to the printing position;

an image forming unit configured to form an image to be printed on the paper sheet and to print the image on the paper sheet conveyed to the printing position; and a control unit configured to perform a primary paper feeding in which the registration unit is not operated but the paper feeding unit is operated so that the paper sheet is conveyed from the paper feeding position to the registration position, to finish the primary paper feeding by stopping operation of the paper feeding unit at a predetermined time after the paper sheet reaches the registration position, wherein the control unit measures waiting time after the primary paper feeding is finished until a printing preparation for printing the image on the paper sheet is done, and when the printing preparation is done, if the waiting time is longer than a predetermined threshold time, when the printing preparation is done, the control unit starts to operate the paper feeding unit and, after having started to operate the paper feeding unit, starts to operate the registration unit, and if the waiting time is the threshold time or less, when the printing preparation is done, the control unit starts to operate both the paper feeding unit and the registration unit at the same time.

6. The image forming apparatus according to claim 5, wherein when the printing preparation is done, if the waiting time is longer than the predetermined threshold time, the control unit delays an operation start timing of the registration unit as the waiting time is longer.

7. The image forming apparatus according to claim 6, further comprising a storage unit for storing timing information in which time differences between an operation start timing of the paper feeding unit and the operation start timing of the registration unit, are determined in advance, so that the time difference is larger as the waiting time is longer, wherein when the printing preparation is done, if the waiting time is longer than the predetermined threshold time, the control unit determines the time difference corresponding to the waiting time based on the timing information, so as to delay the operation start timing of the registration unit from the operation start timing of the paper feeding unit by time corresponding to the determined time difference.

8. The image forming apparatus according to claim 5, wherein there is no roller for conveying the paper sheet on the paper sheet conveying path between the paper feeding position and the registration position.

* * * * *